US011987410B2

(12) United States Patent
Gutierro Aduriz et al.

(10) Patent No.: US 11,987,410 B2
(45) Date of Patent: May 21, 2024

(54) PROCEDURE FOR THE FILLING OF SOLIDS IN PHARMACEUTICAL CONTAINERS AND THE SEALING THEREOF UNDER STERILE CONDITIONS

(71) Applicant: LABORATORIOS FARMACÉUTICOS ROVI, S.A., Madrid (ES)

(72) Inventors: Ibon Gutierro Aduriz, Madrid (ES); Maria Garcia Amo, Madrid (ES); Elena Cebadera Miranda, Madrid (ES)

(73) Assignee: LABORATORIOS FARMACÉUTICOS ROVI, S.A., Madrid (ES)

( * ) Notice: Subject to any disclaimer, the term of this patent is extended or adjusted under 35 U.S.C. 154(b) by 206 days.

(21) Appl. No.: 17/235,012

(22) Filed: Apr. 20, 2021

(65) Prior Publication Data

US 2021/0316890 A1 Oct. 14, 2021

Related U.S. Application Data

(63) Continuation-in-part of application No. PCT/ES2019/070740, filed on Oct. 30, 2019.

(30) Foreign Application Priority Data

Nov. 2, 2018 (ES) ..... ES201831060

(51) Int. Cl.

| | |
|---|---|
| ***B65B 3/00*** | (2006.01) |
| ***B65B 1/32*** | (2006.01) |
| ***B65B 55/18*** | (2006.01) |

(52) U.S. Cl.
CPC ..... *B65B 3/006* (2013.01); *B65B 1/32* (2013.01); *B65B 55/18* (2013.01)

(58) Field of Classification Search
CPC ..... B65B 1/32; B65B 55/18; B65B 3/006
USPC ..... 53/425
See application file for complete search history.

(56) References Cited

U.S. PATENT DOCUMENTS

| | | | | |
|---|---|---|---|---|
| 2,524,560 | A | 10/1950 | Cote | |
| 6,065,270 | A | 5/2000 | Reinhard | |
| 6,189,292 | B1 * | 2/2001 | Odell | B65B 3/003 53/425 |

(Continued)

FOREIGN PATENT DOCUMENTS

| | | | |
|---|---|---|---|
| CN | 203265193 | U | 11/2013 |
| CN | 207768787 | U | 8/2018 |

(Continued)

*Primary Examiner* — Robert F Long
*Assistant Examiner* — Xavier A Madison
(74) *Attorney, Agent, or Firm* — INNOVAR, L.L.C.; Rick Matos

(57) ABSTRACT

A sterile procedure for the filing of solids into pharmaceutical containers and the sealing thereof under sterile conditions is provided. Exemplary containers include syringes, vials, capsules, ampoules, single-dose devices or cartridges. The containers can be filled with powder, granules, nanoparticles or microparticles. After sealing, the containers are airtight. More specifically, the procedure minimizes adherence of those solids to the interior surfaces of the containers during the filling and sealing steps, thus ensuring airtightness of the seal and precision of the weight of the solid dispensed into the containers.

13 Claims, 7 Drawing Sheets

(56) References Cited

U.S. PATENT DOCUMENTS

| | | | | |
|---|---|---|---|---|
| 7,284,574 | B2 * | 10/2007 | Fontaine | G01G 13/24 366/279 |
| 11,142,352 | B2 * | 10/2021 | Gandhi | G01G 13/02 |
| 11,827,391 | B2 * | 11/2023 | Cebadera Miranda | G01G 17/00 |
| 2012/0055579 | A1 * | 3/2012 | Nufer | G01G 13/003 141/83 |
| 2016/0200461 | A1 | 7/2016 | Broadbent et al. | |
| 2017/0028130 | A1 | 2/2017 | Perazzo | |
| 2017/0281876 | A1 * | 10/2017 | Odell | B65B 55/027 |
| 2018/0155068 | A1 * | 6/2018 | Bailey | B65B 1/32 |
| 2019/0185187 | A1 * | 6/2019 | Gandhi | B65B 1/28 |
| 2021/0316890 | A1 * | 10/2021 | Gutierro Aduriz | B65B 61/00 |

FOREIGN PATENT DOCUMENTS

| | | | |
|---|---|---|---|
| EP | 2078674 | A1 | 7/2009 |
| EP | 2711096 | A2 | 3/2014 |
| GB | 2271347 | A | 4/1994 |
| JP | 2005001818 | A1 | 1/2005 |
| WO | 2014189965 | A1 | 11/2004 |
| WO | 2016185230 | A2 | 11/2016 |
| WO | 2018017561 | A1 | 1/2018 |

* cited by examiner

PROCEDURE FOR THE FILLING OF SOLIDS IN PHARMACEUTICAL CONTAINERS AND THE SEALING THEREOF UNDER STERILE CONDITIONS

CROSS-REFERENCE TO EARLIER FILED APPLICATIONS

The present application claims the benefit of and is a continuation-in-part of international application PCT/ES2019/070740 filed Oct. 30, 2019, which claims the benefit of Spanish application No. P201831060 filed Nov. 2, 2018, the entire disclosures of which are hereby incorporated by reference.

FIELD OF THE INVENTION

The present invention falls within the field of filling and sealing under sterile conditions of pharmaceutical containers including syringes, vials, capsules, ampoules, single-dose devices or cartridges that have been filled with solid substances selected from the group formed by powder, granules, pellets, nanoparticles, or microparticles, obtaining the sealing of these solid substances. More particularly, the field of the invention relates to a procedure for the filling and sealing of pharmaceutical containers which have been filled with one or more sterile solid pharmaceutical substances or sterile excipients dispensed and prepared in an aseptic environment which avoids adherence of the said substances to the sides of the pharmaceutical containers, thus ensuring the tightness of the container seal.

BACKGROUND ART

In the pharmaceutical industry, the filling process of pharmaceutical containers is often carried out with liquid pharmaceutical substances and/or freeze-dried solids, as these are much easier to handle and involve fewer dosing problems than solids such as powders, granules, pellets, nanoparticles, microparticles, and others. The use of solids such as those mentioned above in the container filling process has the major drawback that these solids tend to adhere to the walls or body of the containers, preventing or at least hindering the obtaining of the necessary tightness in the container seal. This adherence to the walls or to the body, in addition to preventing the desired tightness, leads to contamination of the containers and loss of doses, as containers in which such adherence to the walls is observed must be discarded because as part of the solid remains in the sealing area of the container walls, it is not possible to know the exact amount of solid that will be delivered to the patient. On the other hand, with regard to contamination, as the dispensed solid remains adhered to the walls of the sealing area, the stopper used to seal the container does not close hermetically, so it will not be able to prevent the entry of substances from the environment into the container and will not ensure the integrity of the product, such that its physicochemical and microbiological properties may vary, affecting the quality of the medicinal product. This is the biggest drawback that the pharmaceutical industry can encounter in this field due to the strict conditions imposed by the regulations of the industry, which must also comply with the standards known as Good Manufacturing Practices (GMPs).

Another concern for the pharmaceutical industry is ensuring the integrity of the closure, which also affects safety, as small losses of the medicine can affect the safety of the healthcare workers handling it. The term integrity here refers to the ability of a container closure system to maintain product sterility and quality of final sterile pharmaceutical, biological and vaccine products throughout their lifetime. A sterile product is also defined as a product free of microorganisms, whose composition is one or more of the elements exposed to aseptic conditions and which ultimately make up the sterile finished pharmaceutical product. These elements include the containers, closures, and components of the finished pharmaceutical product.

When dosing powder into pharmaceutical containers, several factors affecting the cleanliness of the inner walls of the containers must be considered, as lack of cleanliness results in contamination. These factors are listed below:

The static charge of the walls of the pharmaceutical containers used for filling, as well as the static charge of the solid that is dispensed into them: if the wall and solid loads have opposite charges, the dispensed solid will adhere to the container walls.

The kinetic energy that both the dispensed solid and the elements in contact with it acquire when the solid falls into the containers: the greater the height from which the solid to be dispensed falls freely to the bottom of the containers, the greater the kinetic energy acquired by the solid and the elements due to friction. The length of the dispenser needles (also known as nozzles) used for dosing, as the longer the dispenser is and the closer it is to the top of the dispensed solid in the container, the less kinetic energy it will have. In addition, the dispenser conveys the dispensed solid to an area away from the wall surfaces of the container used. The ideal distance between the dispensed solid and the tip of the dispenser will depend on the dispensing rate and the density of the solid dispensed.

Redirection of the air displaced inside the containers. This phenomenon is related to the kinetic energy of the dispensed solid when it is released into the container. During dispensing, the inrush of the solid into the container displaces the air inside the container upwards. This displaced air is full of suspended particles. Thus, the dispenser can be thought of as a "chimney" that moves the air stream away from the interior walls, preserving them from this contamination.

The use of large airflow streams (unidirectional or turbulent regime) in filling cabins or filling sites as required by international Pharmacopoeias to ensure the removal of any foreign particles that may contaminate the final product from the aseptic filling and sealing process. The use of these airflow streams makes filling with solids quite difficult, as a disturbance is generated that causes the solid to adhere to the walls of the container used for filling.

In order to eliminate the adherence of the solid to the walls of the container, one of the measures used is to perform a process of ionization of both the container and the solid to be filled in it.

Ionization is a chemical or physical phenomenon by which ions are produced. Ions are atoms or molecules that are electrically charged due to an excess or lack of electrons relative to a neutral atom or molecule. The chemical species with more electrons than the neutral atom or molecule is called an anion, having a net negative charge, and the one with fewer electrons is called a cation, having a net positive charge.

The ionization process employed in the present invention is used both to neutralize the electrostatic charge of the pharmaceutical container to be filled with the pharmaceutical solid, and to neutralize the electrostatic charge of the solid to be dispensed, i.e., for both the container and the contents. This ionization is also used to neutralize the elements of the dosing and capping equipment that come into contact with the container and/or the powder. For this purpose, the ionizer generates ions of both polarities which are projected onto the surface of the object to be neutralized, where ions of opposite signs are recombined and those of the same sign are rejected.

However, with this ionization process only it is not possible to avoid the serious problem of adherence to the sides of the container during the process of filling the containers with solids, because when the solid is filled through the nozzle, the kinetic energy carried by the solid generates turbulence inside the container that eventually again causes part of the solid to stick to the walls or the body of the container.

As regards the prior art, the documents cited below describe the ionization technique that results in the neutralisation of electrical charges applied to various situations:

US 2016/0200461 A1 of VANRX Pharmasystems INC. describes a method for volumetric filling and aseptic sealing of containers such as vials, bottles, syringes and ampoules with a liquid pharmaceutical product (which can be subsequently lyophilized) in a controlled environment. This publication mentions concerns regarding the materials from which the containers are made, whether glass or polymeric materials. On one hand, glass containers suffer from breakage, scratching, and particle emission due to collisions between them. On the other hand, containers made of polymeric materials are more resistant than those made of glass, although they suffer from cosmetic defects such as scratches, which can impair the quality of the pharmaceutical product due to collisions.

A substantial difference in the present invention with respect to the document cited is that the compounds handled are solid substances that are much more difficult to dose, since they are highly charged and have a higher specific surface area. Moreover, in the above-mentioned document the sealing process comprises two stages, a partial stage and a second complete stage due to the need for freeze-drying after the first partial sealing.

In addition, it should be noted that the filling process of solid substances is much more complex due to the fact that the solid substances remain adhered to the walls of the pharmaceutical containers, impairing the precision of the dosage, which is more relevant in small calibre containers where it is necessary to dose small quantities of medicines in a very precise way. This drawback is solved by the procedure proposed in the present invention, since it must be taken into account that, in the pharmaceutical industry, an error in the filling of the active ingredient may mean that patients will receive an incorrect dose of the product.

This is a serious drawback when filling containers with solids due to the problem of the adherence of the solid to the body of the containers. For this reason, in most of the procedures used today in the pharmaceutical industry, certification of the equipment is mandatory to ensure that the dispensed quantity is adequate. In addition, various in-process controls are incorporated during packaging to verify the actual filling quantity of all pharmaceutical containers. A common control is weighing the containers, which allows one to rectify or discard containers in which the quantity of pharmaceutical substance, either drug or active ingredient, does not meet the required weighing accuracy. In-process controls can be 100% or statistical; the latter are carried out from time to time to check the dosage. These controls involve a high production and economic cost, which is necessary to control the precision of the product dosage.

As for the elimination of electrostatic charge, several types of ionizers are available for dealing with this problem. These ionizers come in various shapes, such as ring, rod, gun, curtain, blade, barrel, needle, or filter ionizers, including isolators with an ionizer on the top of the isolator, among others.

The art discloses removal of the static charge of solids by ionizers.

European patent EP 2711096 A2 of TRINC Corporation relates to a device for the removal of electrostatic charge and dirt from objects such as film, foil, glass, clothing, paper or the like. The device comprises a large container with an opening at the top and an opening at the bottom for suctioning and discharging the powder and a small cylindrical or conical container inside the large container. This small container is designed to generate a cyclone current and tornado current within it and comprises at least one corona discharge ion generator. This ion generator consists of electric discharge needles that are placed either on top of or inside the small container. The small container comprises air injection openings through which compressed air is injected, as well as ultrasound generators inside or outside the small container meant to make the powder vibrate so that it can be separated from the desired object once it has been neutralized by the ion generator. This powder can be collected by vacuum suction inside the large container. EP 2711096 A2 only ionizes the powder and does not ionize the container; moreover it uses compressed air to facilitate suction. EP 2711096 differs further from the present invention in that, although in both it is important to eliminate the electrostatic charge of the solid, said document does not discuss in detail the method by which this is carried out, mentioning only the use of an ion generator such as discharge needles for deionization, without mentioning the problem caused by the electric discharge needles when they approach any solid, namely the appearance of a combustion phenomenon burning the product, generating impurities and altering the physicochemical composition of the product.

JP 2005001818 A of YMS KK discloses a powder supply device and an air conveying device capable of feeding easily-charged powder and charged powder. This device comprises a hopper equipped with aeration means that are in turn equipped with a microporous diaphragm to aerate the powder in the hopper. The air for aeration is pre-ionized by an ionization device such as a corona discharge device. Compressed air supplied by an air compressor is used for aeration. This compressed air is ionized by an air ionization device comprising a corona discharge device or the like. When the aeration is performed by ionized air, the ionized air neutralizes or removes the surface charge of the powder, so that the surface charge of the charged powder disappears. In addition, when aeration causes the powder in the hopper to inflate air and a layer of air forms between the powder and the inner wall of the hopper, the powder is prevented from becoming charged again. In addition, this document refers to a suction nozzle or needle made of conductive material that forms part of the air conveying device. This nozzle is never a dosing nozzle. They also employ a suction nozzle made of conductive material, and they only mention the use of a corona discharge ionizing device.

CN 203265193U to Meech Static Eliminators Shanghai Co LTD make reference to static electricity and powder removal from the inner wall of bottles, prior to filling, for container cleaning, using for this purpose an ion needle with compressed air to eliminate static electricity and remove the powder adhering to the walls of the bottle. The device consists of a needle, a first tube connecting the needle and a second tube for connecting the electrical cable, the two ends of which have an internal thread or an external thread respectively. The needle tip and the second tube are screwed and fixed together, and the needle tip, the first tube and the second tube have an interconnected inner passage for the passage of air, and the second tube also has at least two threads, so that the passage thread is also connected to the inner bore of the first tube. The tube features uniformly spaced wire holes between the inner and outer wall, each of these holes forming an ion-generating end at one extreme of the second tube that fits into the first member of the tube. The ions can be introduced into the surface of the proposed object through the ion needle and with the help of compressed air. They require cleaning the surfaces of the bottles prior to filling rather than after filling.

WO 2016/185230 A2 of 3P Innovation Limited describes an apparatus and method for filling pharmaceutical containers such as syringes, vials, capsules, cartridges and blister packs with powdered pharmaceutical material by vibration. This apparatus has a support for the pharmaceutical container, a tank containing pharmaceutical powder, this tank being in contact with a nozzle or filling needle in charge of filling the pharmaceutical container with the pharmaceutical powder, and a piezo-electric vibration device. This document relates to the advantage of using a cylinder comprising an electrically conductive material, which can be grounded through the weighing cell, thereby helping dissipate the static charge of plastic pharmaceutical containers to achieve a better powder filling process without compromising cleanliness. However, the invention described would not require the material to be electrically conductive, since it is a process for filling through the mouth of the container, so that the problem of sealing that occurs when filling from the back of the container would not arise. They only disclose the filling of plastic pharmaceutical containers such as containers. They also require a cylinder or puck with an electrically conductive material meant to dissipate the static charge of the pharmaceutical containers during filling thereof.

The filling of glass containers with solid materials under sterile conditions is a known challenge in the pharmaceutical industry due to the adherence of the solid substances to the walls of the sealing area of the containers. This adherence results in significant inconveniences, because this adhesion hinders both the filling and the aseptic sealing processes. The filling process must comply with the regulations indicated in the various international Pharmacopoeias, in addition to complying with good manufacturing practices (GMP).

The international Pharmacopoeias require for aseptic filling and sealing the presence of large air flow streams (unidirectional or turbulent regime) to ensure the removal of any extraneous particles that may contaminate the final product. The use of these airflow streams makes filling with solids quite difficult, as a disturbance is generated that causes the solid to adhere to the walls of the container used for filling.

As the solid substances dispensed adhere to the walls of the container sealing area, they are not able to coalesce in the mouth area of the container, thus preventing the necessary sealing from being achieved. This lack of sealing leads to two serious problems: the loss of doses of the solid substance dispensed and the contamination of the container used for filling.

The loss of doses leads to inaccuracy in the administration of the pharmaceutical product, as the solid substances adhering to the walls of the container sealing area will be measured by the weighing cell indicating the precise amount of product to be administered to the patient, but when it is administered to the patient, they will receive a lower dose than indicated, as the solid substances adhering to the sides of the container will not be administered and will remain stuck to the sides of the container.

With regard to the contamination of the container that has been used for filling, this is perhaps the most serious of the drawbacks that can result from the lack of airtightness caused by substance adhering to the walls of the sealing area, as it affects the integrity of the medicinal product and has an impact on the health of the patient receiving the pharmaceutical product. When sealing the container with the stopper, if the walls of the container have solid substances adhered to the sealing area, these substances will remain in this area after the container is sealed, which means that the stopper cannot ensure the integrity of the sealed product, as any kind of substance from the environment could enter the product after the capping stage. Microbial contamination is a very serious issue for pharmaceutical companies, as their products are ideal breeding grounds for micro-organisms such as bacteria, fungi or yeasts. A theoretically sterile but contaminated product can lead to deterioration of the product, loss of the product's potential, pyrogenic reactions after administration to the patient, particularly in parenteral administration, infection and colonization of micro-organisms in the patient, with the risk of secondary infection. Any micro-organism, whether pathogenic or non-pathogenic, found in a supposedly sterile pharmaceutical product is a hazard.

SUMMARY OF THE INVENTION

The present invention seeks to overcome one or more disadvantages of the prior art processes and corresponding equipment. The present invention addresses the drawbacks related to the adhesion of said solid substances to the walls of pharmaceutical containers during a filling process and is thus able to overcome the well-known problems associated with the filling of (glass) pharmaceutical containers with solid materials, in particular dry powder. The present invention may employ all types of materials for the container.

In view of the significant problems caused by the lack of sealing in prior art devices, the present invention offers a solution to the adherence of solid substances to the sides of the sealing area of the pharmaceutical container by achieving the sealing of containers containing said substance. Two methods are used to promote the sealing of the solid substances, namely the control of the height of the dispensing needle and the ionization of both the pharmaceutical container used for filling and the solid substance to be dispensed, as well as the ionization of the elements of the dispensing and capping equipment that come into contact with the syringe and/or the powder.

The process and equipment of the invention at least minimize or preferably prevent the formation of electrostatic charges during the filling of pharmaceutical containers with solid(s). The invention employs ionization (directly or indirectly) of the inner walls of the container and ionization of the solid(s) at least during the filling step.

At least one of the problems solved by the present invention is to provide a procedure for filling solid substances into pharmaceutical containers while minimizing adherence of said substances to the interior surfaces of said containers.

The invention provides two key advantages. It achieves accuracy in the filling of substances into a single container even when two or more filling stations are used, by preventing the solid substances from sticking to the sides of the container. It ensures the integrity of the seal of the pharmaceutical container, which is especially important in the case of medicinal products as it prevents both the entry of foreign agents into the container that would contaminate the product, and the leakage of the product to the outside affecting the effective dose of the product. Additionally, the present invention also solves the problem of static charges generated by collisions between the containers used for filling, whether they are made of glass or polymeric material, in a sterile environment that is generally subject to laminar or turbulent flows which increase the movement and dispersion of electrostatic charges.

The solution to the problem described in the present invention is based on the fact that the inventors have found that such a problem can be satisfactorily solved by means of the techniques disclosed herein, which can be conducted independently or in any combination.

An aspect of the invention provides a method of filling pharmaceutical container(s) with at least one pharmaceutical solid, the method comprising the steps of providing at least one pharmaceutical container with respective interior surface(s);

providing at least one pharmaceutical solid;

loading said at least one pharmaceutical solid into said at least one pharmaceutical container; and at least before said loading, ionizing said at least one pharmaceutical container, said at least one pharmaceutical solid, or both, to reduce or dissipate static electricity on said at least one pharmaceutical container, said at least one pharmaceutical solid, or both.

The invention also provides a method of filling pharmaceutical container(s) with at least one pharmaceutical solid, the method comprising the steps of providing at least one pharmaceutical container with respective interior surface(s);

providing at least one pharmaceutical solid;

directly or indirectly ionizing at least said pharmaceutical container to reduce or dissipate electrostatic charge on said at least one pharmaceutical container;

loading said at least one pharmaceutical solid into said at least one pharmaceutical container; and optionally, directly or indirectly ionizing said at least one pharmaceutical solid before, during, and/or after said loading.

The invention also provides a method of filling pharmaceutical container(s) with at least one pharmaceutical solid, the method comprising the steps of providing an electrically conductive receptacle for at least one pharmaceutical container;

placing at least one pharmaceutical container, with respective interior surface(s), in said receptacle;

directly or indirectly ionizing at least said receptacle and at least said pharmaceutical container to reduce or dissipate respective electrostatic charge(s); then loading at least one pharmaceutical solid into said at least one pharmaceutical container; and optionally, directly or indirectly ionizing said at least one pharmaceutical solid before, during, and/or after said loading.

The invention also provides a method of filling pharmaceutical container(s) with at least one pharmaceutical solid, the method comprising the steps of providing an electrically conductive receptacle for at least one pharmaceutical container;

placing at least one pharmaceutical container, with respective interior surface(s), in said receptacle;

directly or indirectly ionizing at least said receptacle and at least said pharmaceutical container to reduce or dissipate respective electrostatic charge(s); then loading at least one pharmaceutical solid into said at least one pharmaceutical container and weighing said container during said loading; and directly or indirectly ionizing said at least one pharmaceutical solid before, during, and/or after said loading.

The invention also provides a method of filling pharmaceutical container(s) with at least two pharmaceutical solids, the method comprising the steps of providing an electrically conductive receptacle for at least one pharmaceutical container;

placing at least one pharmaceutical container, with respective interior surface(s), in said receptacle;

directly or indirectly ionizing at least said receptacle and at least said pharmaceutical container to reduce or dissipate respective electrostatic charge(s); then loading a first pharmaceutical solid into said at least one pharmaceutical container and weighing said container during said loading;

directly or indirectly ionizing said first pharmaceutical solid before, during, and/or after said loading;

loading a second pharmaceutical solid into said at least one pharmaceutical container and weighing said container during said loading;

directly or indirectly ionizing said first and second pharmaceutical solids in said container before, during, and/or after said loading.

In some embodiments, the method (process) of the invention further comprises one or more of the following steps: a) gravimetrically checking the weight of solid dispensed into the container; b) sealing the pharmaceutical container; c) ionizing any parts in contact with said receptacle, said container walls, or with the solid dispensed inside the container; d) said loading is conducted with a vibrating dispenser; e) repeating said loading and ionizing steps to load more than one pharmaceutical solid into said container; f) conducting an ionized sterile gas stream to the inside of the pharmaceutical container during loading, ionizing, and/or sealing; g) placing said container into a grounded and electrically non-conductive holder (cylinder), preferably before said loading; h) ionizing the container(s) before and after placement into respective receptacle(s) (cylinder(s)); i) ionizing with ionized sterile gas stream; j) ionizing with ionizer(s); k) ionizing with ionized sterile gas stream and with ionizer(s); l) sterilizing at least said pharmaceutical container prior to said loading; m) providing an electrically conductive receptacle (cylinder) within which said pharmaceutical container is placed prior to said loading; n) directly or indirectly ionizing said electrically conductive receptacle; o) directly or indirectly ionizing said electrically conductive receptacle and said pharmaceutical container; p) weighing said container during said loading; q) sealing said container after completion of said loading; and/or r) directly or indirectly ionizing said container before and/or during said sealing.

In some embodiments, a) the static charge(s), if present after said ionizing, on said interior surfaces is less than 2000 volts, less than 1000 volts, less than 500 volts, or less than 200 volts; b) said ionizing is conducted within the interior of said container; c) said ionizing is carried out when the pharmaceutical container is empty (prior to filling); d) one or more ionizers are located on the outside and/or inside of the pharmaceutical container; e) said ionizing is conducted before and/or during sealing of said container; f) the tip of a dispenser for said loading is at a height (h) of about 1 to about 3 mm (or about 2 mm) above the surface of respective solid deposited in the container; g) a dispenser for said loading is vertically displaceable during said loading, whereby said dispenser moves upwards as the filling stage progresses in order to maintain the distance (h) between the dispensing end of the dispensing needle and the surface of the loaded solid; h) said container and a dispenser for said loading are both vertically displaceable during said loading in order to maintain the distance (h) between the dispensing end of the dispensing needle and the surface of the loaded solid; i) the container is filled (loaded) from the distal part with respect to a collar of the container when the container is a syringe or cartridge; j) the container is filled from the distal part with respect to a nozzle of the container when the container is a syringe or cartridge; k) the container is sealed under vacuum; l) said ionizing is conducted with at least one ionizer selected from the group consisting of ring, rod, bar, gun, curtain, blade, gun, needle or filter ionizer(s), and isolator(s) with an ionizer on the top thereof; m) a dispenser load solid(s) from at least one hopper into said container; n) a dispenser and/or hopper are made of a non-conductive material; o) the container comprises an electrically non-conductive material; p) a tip of the dispenser comprises a containment element to prevent said solid from being dispersed above the level of the dispensing tip or end of the dispensing tip during filling; q) one or more steps of said process is conducted in an aseptic environment in an area with unidirectional air flow; r) said ionizing is conducted before and during said loading; or any combination of two or more of the above.

The invention also provides a system for loading pharmaceutical solid(s) into pharmaceutical container(s), the system comprising

- plural receptacles adapted to receive and temporarily retain respective pharmaceutical container(s);
- at least one first ionizer adapted to directly or indirectly reduce or dissipate electrostatic charge on interior surface(s) of said pharmaceutical container;
- at least one dispenser of pharmaceutical solid(s);
- at least one weighing cell adapted to gravimetrically weigh said container(s) and said pharmaceutical solid(s) during loading of said solid(s) into said container(s);
- at least one other ionizer adapted to directly or indirectly reduce or dissipate electrostatic charge of said pharmaceutical solid(s).

In some embodiments, the system further comprises a) a sealer for said container(s); b) a reservoir for said container(s); c) a reservoir for said pharmaceutical solid(s); d) an ionizer adapted to form an ionized sterile gas stream; e) a sterilizer for said system and/or said container(s); or f) any combination of two or more of the above.

In some embodiments, a) said receptacles comprise an electrically conductive material; b) said receptacles comprise an electrically nonconductive material; c) said dispenser comprises a height adjustable dispensing end; d) said sealer is adapted to seal said container(s); e) said first ionizer is adapted to directly or indirectly reduce or dissipate electrostatic charge on said receptacle(s); f) said dispenser comprises is adapted to maintain the tip of a respective dispensing end at a height (h) of about 1 to about 3 mm (or about 2 mm) above the surface of respective solid deposited in the container during loading of said solid into said container; g) said dispenser is vertically displaceable during said loading, whereby said dispenser moves upwards as the filling stage progresses in order to maintain the distance (h) between the dispensing end of the dispensing needle and the surface of the loaded solid; h) a tip of said dispenser comprises a containment element to prevent said solid from being dispersed above the level of the dispensing tip or end of the dispensing tip during filling; or i) any combination of two or more of the above.

In some embodiments, the solid substance is a dry solid (comprising less than 15% by wt, less than 10% by wt, or less than 5% by wt of water). The solid may be a particulate solid, such as granules, beads, pellets, or powder.

In some embodiments, the sealing process of the present invention is carried out in a single stage with a complete sealing, without the need to resort to subsequent sealing stages.

In some embodiments, the system, device, apparatus and/or method of the invention may further comprise (employ) a cylinder (receptacle) acting as a support for the container is an optional element. Said cylinder may a) facilitate handling of the container without contact with same; b) protect the process (e.g. containers) from air streams by being part of the "exclusion hood"; and/or c) serve as an element for vertical support of the container on the weighing cell for accurate weighing.

In some embodiments, the solid and container are sterile before filling of the container. The interior of the sealed container and the solid contained therein are sterile. The container may comprise one or more materials that prevent the solid from adhering to the walls of the container and that ensure an airtight sealing of the container.

In some embodiments, the process of the invention comprising ionizing both the solid and the pharmaceutical container where it is to be deposited, as well as ionizing the elements of the dosing and capping equipment that comes into contact with the container and/or the powder, at one or more stages of the filling procedure, in order to prevent the solid from tending to adhere to the walls of the container, as well as the walls of the container from tending to attract the solid particles, so that the only tendency of the solid is to fall to the bottom of the container and not be deposited on its walls. This deionization technique can be applied to the container and the solid separately, as well as to the container with product inside. This deionization can be applied as many times as there are filling and capping steps in the process.

In some embodiments, the process of the invention also comprises controlling the potential applied to the ionizers, which should be such that the resulting electrostatic charge on the container walls and/or the dispensed solid is preferably less than 2,000 V, more preferably less than 500 V, and most preferably less than 200 V.

In some embodiments, the filling of the pharmaceutical container with the solid is preferably carried out using a dispensing needle whose tip or dispensing end is located, throughout the filling stage, at a height between 1 to 3 mm above the surface of the solid deposited on the bottom of the container, so as to avoid turbulence that could lift the deposited solid towards the walls. Even if this turbulence phenomenon were to occur to some extent, ionization of both the solid and the inner walls of the container will make said lifted particles settle back on the bottom of the container, without substantial loss of product on the container walls.

Another aspect the invention provides a process for filling under sterile conditions pharmaceutical containers with solids, the process comprising the steps of:

a) providing a pharmaceutical container (1) having walls and a bottom, b) dispensing the solid into the pharmaceutical container (1) by means of a dispensing needle (4), gravimetrically checking the weight of solid dispensed into the container (1); and c) sealing the pharmaceutical container with a stopper (6), characterized in that, in at least one of steps a), b) and c), or a plurality thereof in any combination, the static electric charges on the inside walls of the container (1), on the solid dispensed inside the container, and/or on any parts in contact with the container walls or with the solid dispensed inside the container, are neutralized by means of an ionizer (2) to which an ionization potential is applied such that the electrostatic charge inside the container (1) after each ionization is less than 2,000 volts. This ionization prevents the solid dispensed into the container from tending to adhere to the inner walls of the container (1), which may distort the amount of solid dispensed into the container, hinder a visual assessment of the level of product dispensed, or even cause incomplete administration of the product to the patient.

In a second aspect, the invention relates to a container (1) containing a solid product, wherein the solid product has been dispensed into the container using the method(s) described herein.

In the case of ionization in the rod/ring embodiment, re-ionization will be performed preferably with a needle with or without an ionizing gas stream.

The invention also provides solids loading system and method comprising a height adjustable dispenser having a dispensing end which height is adjustable during loading of solid into a container. The dispensing end is adapted to fit within a pharmaceutical container during loading of solid into the container.

In general, filling is preferably carried out by means of a dispenser (dispensing needle or nozzle) whose tip or dispensing end is located, throughout the filling stage, at a height of 1 to 3 mm above the surface of the solid deposited on the bottom of the container, in order to prevent generating turbulence that could lift the solid towards the walls of the container.

The invention provides a method of filling pharmaceutical container(s) with at least one pharmaceutical solid, the method comprising the steps of providing a height adjustable dispenser, at least one pharmaceutical container, and at least one pharmaceutical solid; loading said solid into said container by way of said dispenser, wherein during said loading a dispensing end of said dispenser is maintained a distance of about 1 mm to about 3 mm from the upper surface of solid loaded into said container.

The invention also provides a system (apparatus, device, equipment, or equipment assembly) for use in filling pharmaceutical container(s) with at least one pharmaceutical solid, said system comprising a height adjustable dispenser comprising a dispensing end, wherein during loading of said solid into said container, said dispenser is adapted to maintain said dispensing end within a distance of about 1 mm to about 3 mm from the upper surface of solid loaded into said container(s).

Although the invention is generally applicable to powdered solid compounds of any nature, this procedure is particularly applicable to solids having the following particle size distribution:

$D_{10} \geq 20$ microns 70 microns $\leq D_{50} \leq$ 110 microns 150 microns $\leq D_{90} \leq$ 215 microns where $D_{10}$ is the mean value of the particle size that divides the population into exactly two equal halves, with 50% of the distribution being above this value, and 50% below.

The process is also applicable to solids having the following particle size distribution:

$D_{10} \geq 25$ microns 100 microns $\leq D_{50} \leq$ 155 microns 245 microns $\leq D_{90} \leq$ 325 microns.

The invention includes all combinations of the aspects, embodiments and sub-embodiments disclosed herein.

BRIEF DESCRIPTION OF THE FIGURES

The figures accompanying the present invention serve to illustrate the nature of the invention. These figures are included for purposes of illustration only and should not be understood as limiting the invention claimed herein. With respect to the ionization phenomenon, the present invention proposes different methods, some of which are shown in FIGS. 1 to 7 described below. In order to properly interpret the figures, the ionization phenomenon is represented by the alternating positive (+) and negative (−) signs, bearing in mind that this stream of ions of different signs may or may not be accompanied by a stream of sterile carrier gas, although the latter is not represented as such in the figures.

Figure 4:
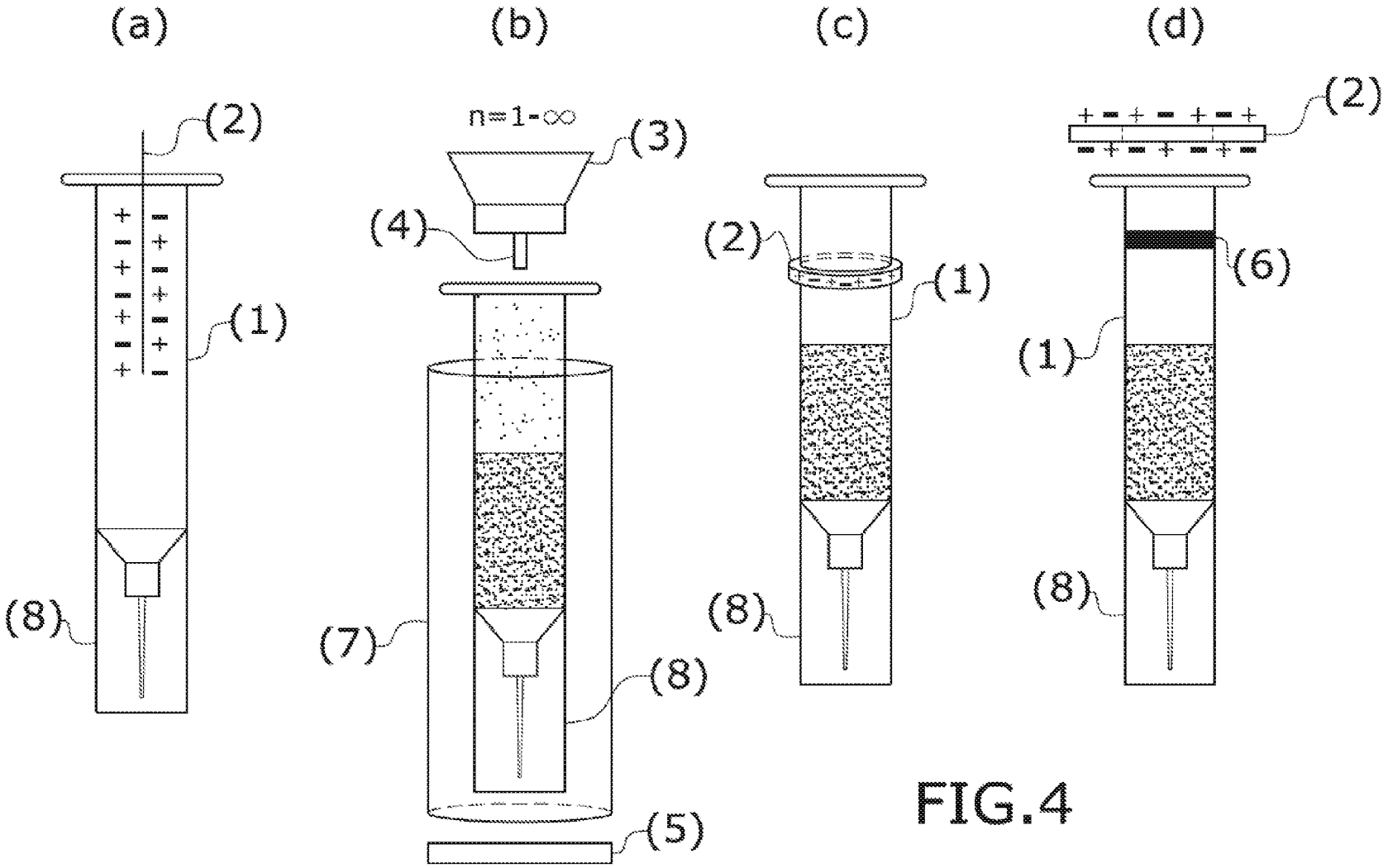

FIG. 4 depicts a particular embodiment of the procedure of the present invention in which the container represented is, in this case, a syringe with needle (1) pre-capped with the nozzle cap (8) throughout the sealing process, which is subjected to a first ionization process (a) with the aid of an ionizer (2) which may be in the form of a ring, bar, gun, curtain, blades, barrel, needle or nozzle, or an ionizing filter, among which can also be found isolators with an ionizer on the top of said isolator, although in this case a needle ionizer is shown. The syringe with needle (1) then passes to the filling station (b), where in the procedure described in the present invention there may be multiple filling stations, in particular if there are multiple solids to be filled into the syringe. In said station, the syringe with needle, which may optionally be inserted in a cylinder (7), is weighed by a weighing cell (5) during filling, which takes place by means of a hopper (3) and a nozzle or dispensing needle (4). After filling, the syringe with needle (1) is subjected to a further ionization step (c) by means of an ionizer (2), with either a ring, rod, gun, curtain, blade, barrel, needle or nozzle, or an ionizing filter, including isolators with an ionizer on the top of the isolator, although in this case a ring ionizer is shown. Finally, the syringe with needle (1) is transferred to a sealing station (d) where it is hermetically sealed at the top with a stopper (6), while it is subjected to an additional ionization stage by means of an ionizer (2) provided at this step, with either a ring, rod, gun, curtain, blades, barrels, needle or nozzle, or an ionizing filter, among which isolators with an ionizer on the top of said isolator can also be found, in this case a rod ionizer.

Figure 5:
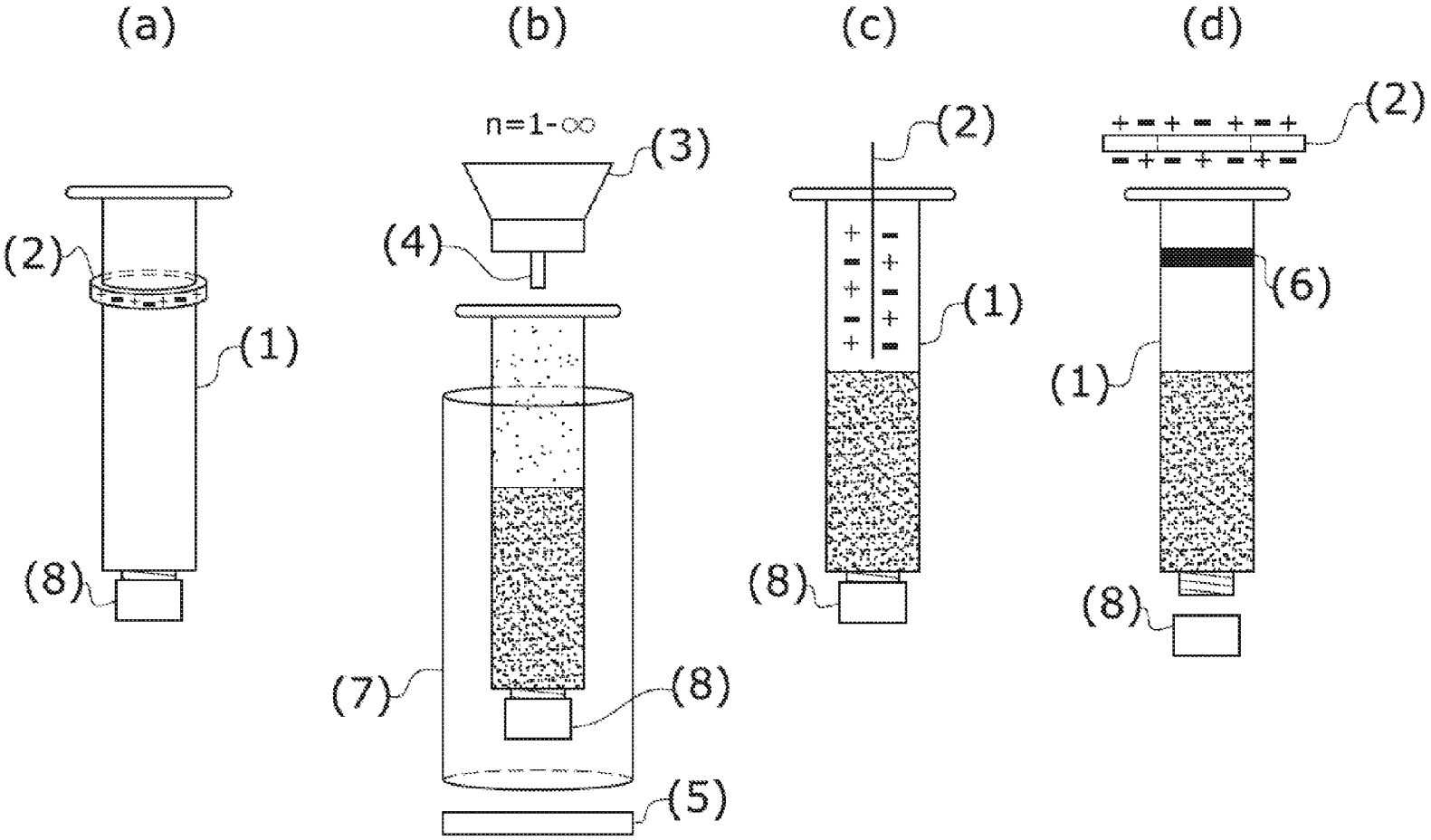

FIG. 5 depicts another particular embodiment of the procedure of the present invention in which the container depicted is, in this case, a female syringe (1) capped throughout the process with a nozzle cap (8), which is subjected to a first ionization process (a) with the aid of an ionizer (2) with either a ring, rod, gun, curtain, blade, barrel, needle or nozzle, or an ionizing filter. Next, the female syringe (1) passes to the filling station (b), where in the procedure described in the present invention there may be multiple filling stations, in particular if there are multiple solids to be filled into the syringe. In said station, the syringe, which may optionally be inserted in a cylinder (7), is weighed by a weighing cell (5) during filling, which takes place by means of a hopper (3) and a nozzle or dispensing needle (4). After filling, the syringe undergoes an ionization process (c) by means of an ionizer (2) in the form of a ring, rod, gun, curtain, blades, barrels, needle or nozzle, or an ionizing filter, including isolators with an ionizer on the top of the isolator, although in this case a needle ionizer is shown. Finally, the female syringe (1) is transferred to a sealing station (d) where it is hermetically sealed at the top with a stopper (6) while it is subjected to an additional deionization phase by means of an ionizer (2), provided at this stage, with either a ring, rod, gun, curtain, blade, barrel, needle or nozzle, or a filter ionizer, among which there may also be isolators with an ionizer on the top of the isolator, in this case, a rod ionizer.

Figure 6:
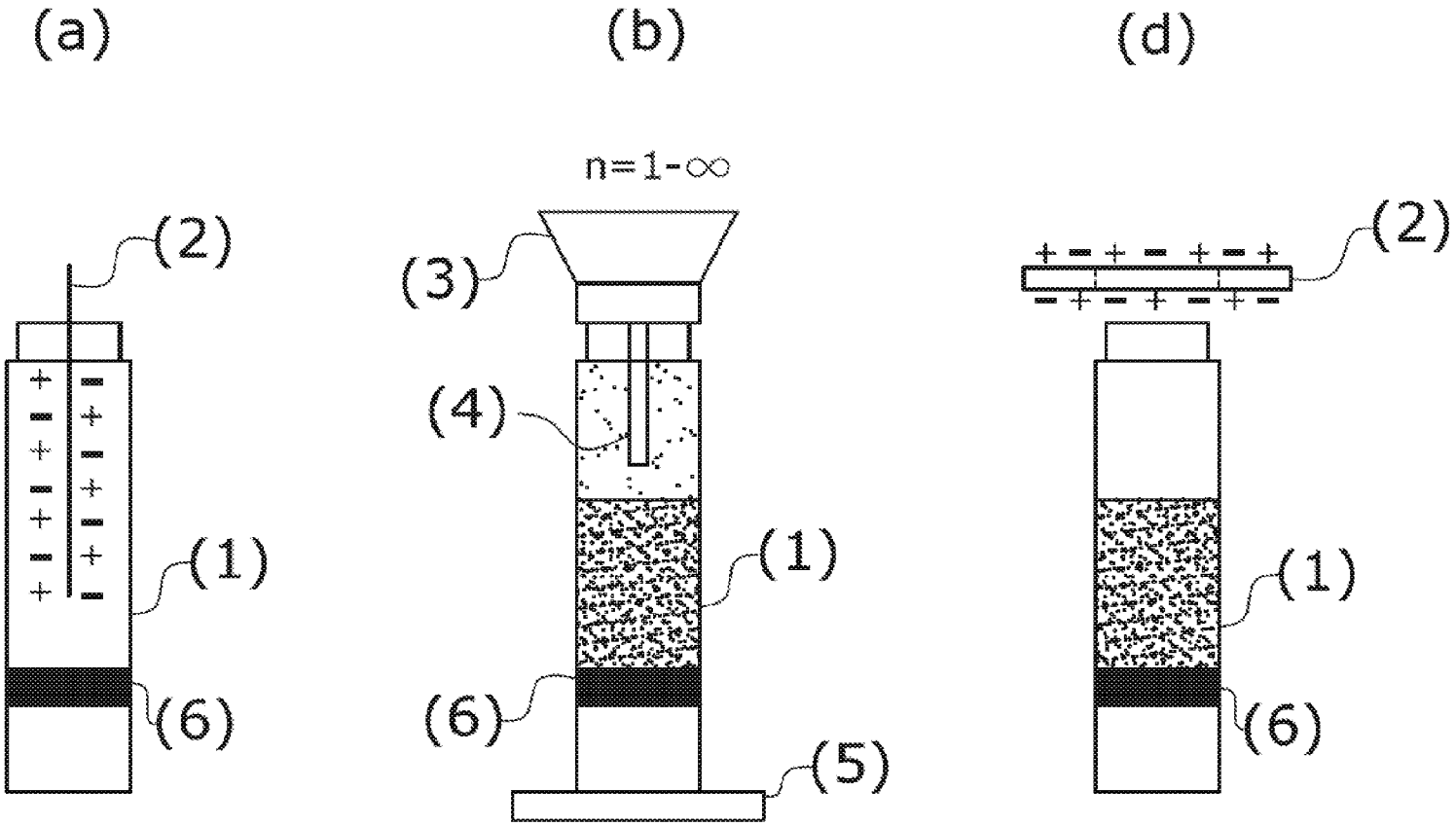

FIG. 6 depicts another particular embodiment of the procedure of the present invention in which the container represented is a cartridge (1), is subjected to a first ionization process (a) with the aid of an ionizer (2) with either a ring, rod, gun, curtain, blades, barrel, needle or nozzle, or an ionizing filter, among which can also be found isolators with an ionizer on the top of said isolator, although in the present case a needle ionizer is represented. The cartridge (1) then passes to the filling station (b), where in the procedure described in the present invention there may be multiple filling stations, particularly if there are multiple solids to be filled into the cartridge. In this station, the cartridge is weighed by a weighing cell (5) during filling, which takes place by means of a hopper (3) and a nozzle or dispensing needle (4). Finally, the cartridge (1), which may optionally be inserted in a cylinder (7), is transferred to an ionization station where an ionizer (2) will act, with either a ring, rod, gun, curtain, blades, barrel, needle or nozzle, or an ionizing filter, or an isolator with an ionizer on the top of the isolator, where in this case a rod ionizer is shown.

Figure 7:
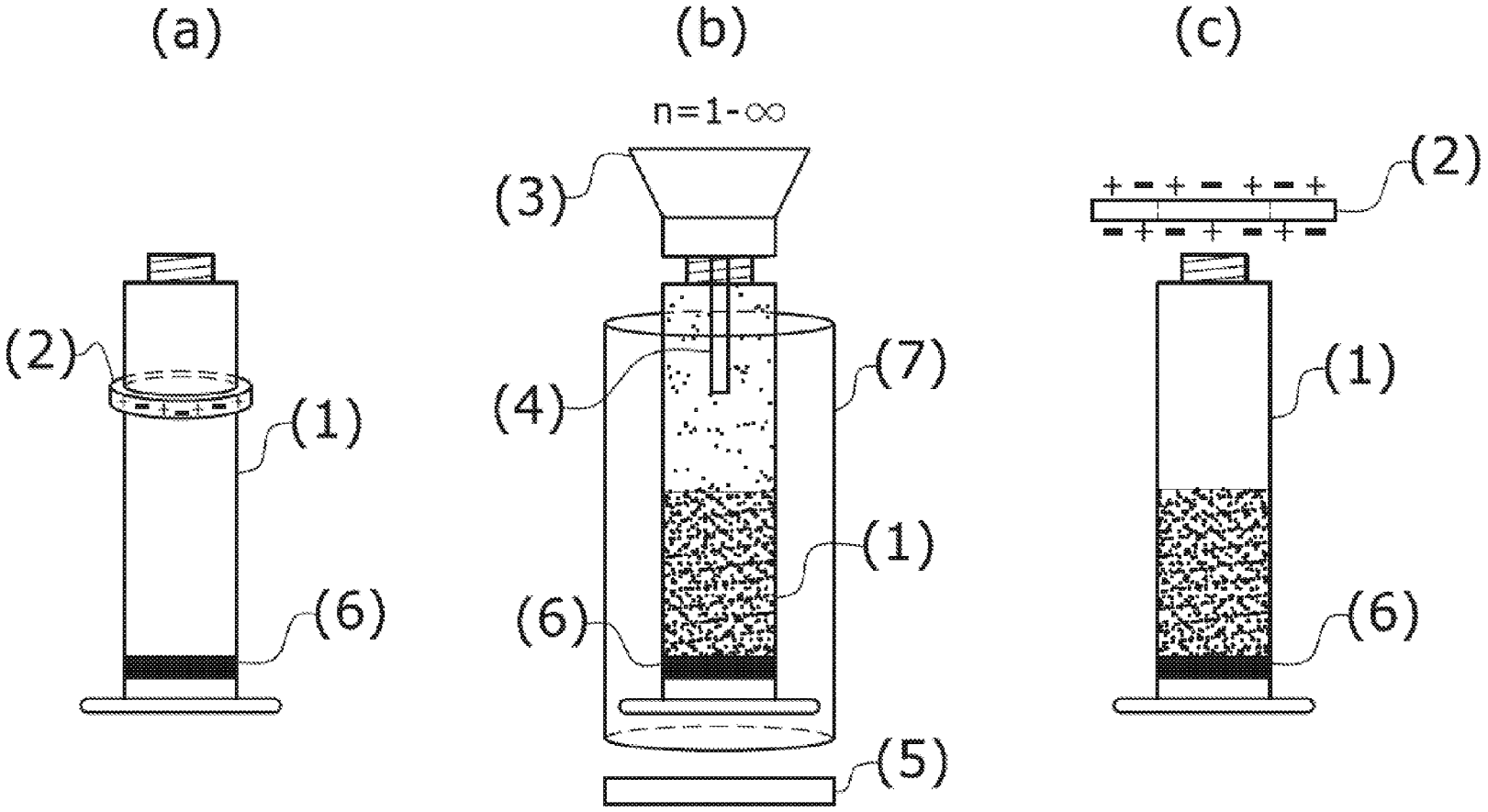

FIG. 7 depicts a particular embodiment of the process of the present invention in which the container represented is, in this case, a pre-filled female syringe (1) which is first subjected to an ionization process (a) with the aid of an ionizer (2) with a ring, rod, gun, curtain, blades, barrels, needle or nozzle, or an ionizing filter, among which can also be found isolators with an ionizer on the top of said isolator, although in the present case one with a ring is represented. After this the syringe, which is filled at its threaded end, is located in the filling station (b), where in the process described in the present invention there may be multiple filling stations, particularly if there are multiple solids to be filled into the syringe. In this station, the syringe, which may optionally be inserted in a cylinder (7), is weighed by a weighing cell (5) during filling, which takes place by means of a hopper (3) and a nozzle or dispensing needle (4). After filling, the female syringe (1) is subjected to a further ionization phase (c) by means of an ionizer (2) with either a ring, rod, gun, curtain, blades, barrels, needle or nozzle, or an ionizing filter, which may also include isolators with an ionizer on the top of the isolator (in this case a rod ionizer).

DETAILED DESCRIPTION OF THE INVENTION

As used herein, the term "non-conductive" refers to "electrically non-conductive".

In the present invention, the terms "process", "stage" and "phase" are used interchangeably, as well as the terms "ionization" and "deionization" or "ionizer" and "deionizer".

In general, throughout this specification, a value denoted as "d0.X" or "Dx" represents the mass fraction of the drug with particle sizes below the specified value, with "x" having a range of 0.0 to 1.0. According to this definition, a value of d0.1 or $D_{10}$ means that 10% of the total mass of the drug particles has particle size at or below the respectively specified value. In other words, "d0.1 <10" microns means that 10% of the total mass of the drug particles has particle size of less than 10 microns.

As used herein, "neutralize" refers to neutralization of electrostatic charge. An ionizer is used to neutralize.

As used herein, "ionizer" means any element or device which is capable of ionizing the surrounding air molecules, so that they are then projected onto a surface which has static electrical charges that neutralize those charges, thereby ionizing that surface.

For the purpose of this invention, these ionizers can be installed on the machinery used for the filling process to produce ions of both polarities that neutralize the surface of the containers or products, or they can also be placed in the packaging areas, room or isolators, specifically on the ceiling of the isolators to produce an ionization that neutralizes both the environment and the air flow of the area, thereby eliminating the problem of static charges.

Exemplary ionizers can be in the form of a ring, bar, rod, gun, curtain, blades, barrel, needle or nozzle (e.g. dispensing needle), or an ionizing filter, including isolators with an ionizer on the top of the isolator, which can be installed on the packaging equipment for use prior to filling, during filling and/or after filling, optionally using a sterile carrier gas. The ionizer can also be any other type of such equipment employed in the pharmaceutical industry. The ionizer will neutralize the electrostatic charge of both the container to be filled and the solid to be dispensed into the container. The needle is not made of a conductive material.

The present invention employs deionization of both the container and the powder prior to packaging in order to prevent the powder from sticking to the container walls during the filling process and thus to achieve a complete seal. In addition, as a safety factor, deionization is carried out on and/or inside the container to remove any remaining powder adhered to the walls of the sealing area. The present invention also uses an ionizer, whether in the form of a ring, rod, gun, curtain, blades, barrel, needle or nozzle, or an ionizing filter, including isolators with an ionizer on the top of said isolator, to eliminate static electricity, but it does so both on the powdered solid and the container to be used.

In some embodiments, the present invention does not need an air stream, but if one is employed, it should be of a sterile carrier gas. Among sterile carrier gases, an ionized nitrogen stream has advantages as discussed herein. A characteristic feature of the present invention is the need to carry out the deionization in sterile environments, making the use of sterile carrier gases necessary. It should be noted that this sterile condition of the carrier gas does not negatively affect the deionization process.

In some optional embodiments, the solid substance is ionized and the pharmaceutical container is ionized using a sterile carrier gas stream as the ionized (ionizing) gas, e.g. a stream of sterile nitrogen or air. This may also aid in dosing of the solid by maintaining the necessary sterile conditions required for these procedures in the pharmaceutical industry by generating an inert atmosphere inside the containers.

In some embodiments, deionization and cleaning of walls of the pharmaceutical container(s) occurs after filling and applies to smaller containers than bottles, such as syringes, vials, capsules, ampoules, single-dose devices or cartridges, which are more difficult to fill with a solid such as powder.

In some embodiments, the present invention concerns a process for sealing pharmaceutical containers which are filled with pharmaceutical solids, wherein such filling is carried out under aseptic conditions without the need for terminal sterilization.

Filling of solid into the containers is achieved by volumetric or gravimetric filling. Exemplary solids include powder, beads, granules, pellets, nanoparticles or microparticles.

Exemplary pharmaceutical containers include vials, capsules, ampoules, single-dose devices, inhalers, bottles, blister cartridges, sachets, bags, test tubes, Eppendorf® tubes and syringes (with male or female, threaded or non-threaded nozzles). The syringes of the present invention may have a needle, catheter type cone, or Luer lock type cone, i.e. with an unthreaded tip or with female or male threaded tip, respectively. For the purpose of the present invention, "Luer cone" refers to the cone-shaped tip invented by Wülfing Luer with a typical taper of 6%, which can be male or female depending on the coupling. Likewise, "Luer lock cone" refers to the cone-shaped tip invented by the German Wülfing Luer with an airtight threaded closure.

The containers can comprise any one or combination of materials, such as plastics of different composition, such as polyolefins and cyclopolyolefins, polypropylene, polybutadiene, polyethylene, polystyrene, polyvinyl chloride, polyacrylonitrile, polyamides, etc., polyesters (containing the ester functional group in its main chain), poly(ethylene terephthalate), polycarbonate), acrylic polymers (poly(methyl methacrylate), polyacrylonitrile), thermoplastic resins (polyacetals and polyhaloethylenes), polyurethanes, formaldehyde resins (phenol resin, urea resin), phenoplasts, aminoplasts, thioplasts, duroplastic resins (unsaturated polyester, polyurethanes), polyvinylidene silicones, cellulose derivatives, polycarbonates, and mixtures thereof, etc. Alternatively, the container(s) can also be made of metal, e.g. steel, titanium suitable for drug administration, or glass or other equivalent material.

In turn, both the cylinder or puck, the hopper and the nozzle or needle will preferably be composed of various non-conductive materials such as various plastics, e.g. polyether ether ketone (PEEK), glass, stone, resin, glass, but may also be composed of grounded conductive materials such as steel or titanium, etc.

Both the materials used for the container and the cylinder materials must be watertight, inert, not very permeable or impermeable, that do not absorb and/or adsorb the contained product, and must be not rough and free of particles.

There are a number of factors that affect the adhesion of solids to the inner walls of the container, among which is the length of the nozzle. The longer the nozzle and the closer it is to the top level of powder in the container, the less kinetic energy it will have. In addition, the nozzle carries the powder away from the surface of the sealing walls. The inventors of the present invention have found that the ideal distance between the powder and the nozzle tip depends on the dosage, dispensing rate and density of the powder, although typically it is between 1 and 3 mm, more preferably around 2 mm. The present invention proposes several options regarding the height of the nozzle:

The first of these is based on having a nozzle with an exact height (h) of the nozzle measured from the bottom of the container. In this case, the filling process is carried out at the rear of the container, i.e. when the container is a syringe, at the mouth or end with the largest diameter. A minimum height (h) between the solid to be dispensed and the nozzle must always be kept, specifically about 2 mm.

The second option is to always keep the nozzle at a minimum distance of h=2 mm from the solid substance being dispensed into the container. This method would mean that the nozzle would not be a fixed element, but instead be mobile and could be raised and lowered as the filling process takes place, always maintaining a distance of 2 mm from the solid substance.

An alternative to the above could be that the nozzle be provided with a containment element to prevent the powder from dispersing, during filling, above the area being filled.

There are two types of electrostatic charges, negative charges which are electrons of the atoms of the chemical elements, and positive charges which are equivalent to the action of the protons of the atomic nucleus deprived of the electrons of the last shell. Electrons on the surface of an insulating material cannot be easily dissipated unless they have a conductive path to ground, which is why the cylinder of the invention is made of a conductive element as mentioned above. As they cannot circulate easily, they give rise to what is known as static electricity. Electrons are free to move from molecule to molecule in conductors, but protons are inseparable from the atom and cannot move unless the atom itself moves. The amount of electrostatic charge depends on the position or distance relative to each other of the materials in the series and its sign is determined by the propensity of a material to give up or gain electrons, which is what the series actually indicates.

The present invention uses any type of ionizer, such as a ring, rod, bar, gun, curtain, blade, barrel, needle or nozzle, or an ionizing filter, including isolators with an ionizer on the top of the isolator. For example, a rod can be used to ionize and neutralize both the environment and the air flow, thus eliminating static charges. The ionizer can be implemented in practice by means of a sterile carrier gas stream, such as compressed air or nitrogen $N_2$, preferably using a nitrogen stream, which has the following functions and/or advantages:

This nitrogen current serves as a vehicle for displacing the ions generated at the electrodes of the ionization elements that ionize the surrounding air, producing ions that are carried away by the $N_2$ current. These positive and negative ions are generated by supplying alternating current which, via a transformer, reaches values of up to 8,000 volts with an almost negligible current (4 mA). Surfaces treated in this way end up having a neutral charge due to the recombination of charges of different signs and repulsion of charges of like sign.

Generation of an inert atmosphere inside the containers by displacing the oxygen inside the containers, thus preserving the product from the oxidative effect thereof. The introduction of an inert gas into a vessel, known as inerting, is based on the reduction of the percentage of oxygen below the limiting oxygen concentration (LOC), Carrying means in the sweeping effect inside the containers. Alternating ion generation eliminates the static forces that adhere the powder to the container walls. This makes the solid remain in its position without adhering to the container or between the solid particles themselves. Then a slight air flow (0.1-0.8 l/min) performs a sweeping effect with the now disaggregated solid.

With respect to the ionization phenomenon, the present invention proposes different methods for carrying it out, shown in the accompanying FIGS. 1-7, in which the pharmaceutical container is represented in a non-limiting manner as a male or female syringe, a syringe with needle, a cartridge or carpule, or an Eppendorf® tube. Ionizers can be used with any type of ionizer (whether or not accompanied by a stream of sterile carrier gas), such as a ring, rod, gun, curtain, blade, barrel, needle or nozzle, or an ionizing filter, including isolators with an ionizer on the top of the isolator, such as a rod, to ionize and neutralize both the environment and the airflow, thus eliminating static charges. In the case of isolators, and according to a preferred embodiment, prior to the dosing operation described in the present invention, sterilization with nebulized or vaporized hydrogen peroxide or a mixture of hydrogen peroxide with peracetic acid is required.

When the pharmaceutical container is removed from the tray, it has a very high electrostatic charge (more than 30,000 Volts). This is due to the constant friction between the container and the tray. That is why, as shown in the various figures, both before the container is inserted into the cylinder and after it has been inserted, the containers are preferably exposed to an ionizer of any type and to a stream of sterile carrier gas. This gas can be nitrogen, which carries ionized air molecules, or compressed air, which hits the inside of the container as well as the sealing area in order to suppress the electrostatic charge they have.

Figure 1:
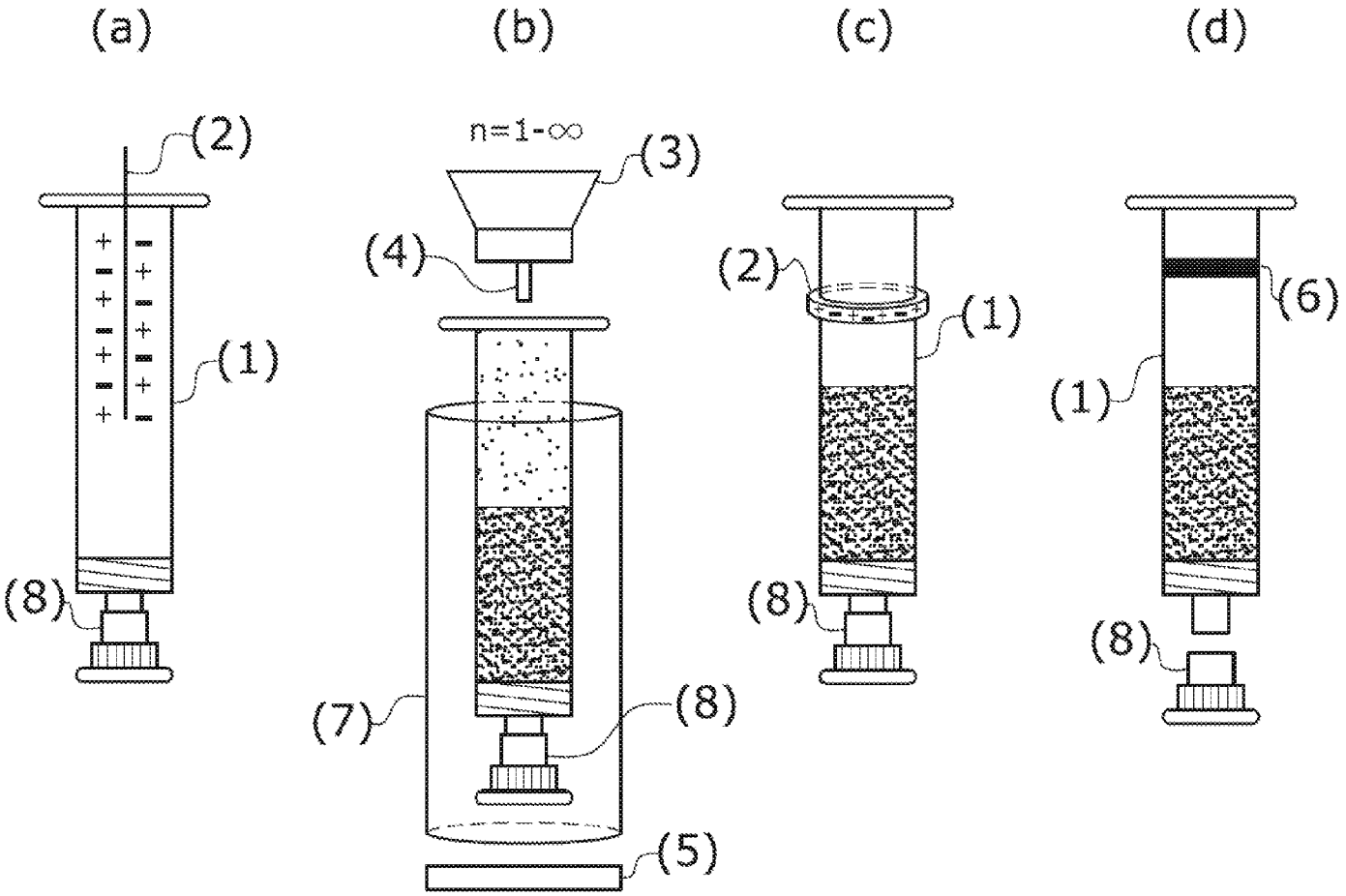
FIG. 1 depicts a particular embodiment of the aseptic filling and sealing process according to the present invention, wherein the pharmaceutical container depicted is, in this case, a male syringe (1) which remains capped with a nozzle cap (8) throughout the process. The syringe (1) is subjected to a first ionization stage (a) with the aid of an ionizer (2), with either a ring, rod, gun, curtain, blade, barrel, needle or nozzle, or an ionizing filter, including isolators with an ionizer on the top of the isolator, although in this case a needle ionizer is shown. The male syringe (1) then passes to the filling station (b), where the procedure of the invention may comprise multiple filling stations, in particular if there are multiple solids to be filled into the syringe. In this station, the syringe, which may optionally be inserted in a cylinder (7), is weighed by a weighing cell (5) during filling, which takes place by means of a hopper (3) and a nozzle or dispensing needle (4). After filling, the male syringe (1) is subjected to another ionization stage (c) by means of an ionizer (2) provided at this stage either by a ring, rod, gun, curtain, blades, barrels, needle or nozzle, or an ionizing filter, among which isolators with an ionizer on the top of the isolator can also be found, although in this case a ring ionizer is shown. Finally, the male syringe (1) is transferred to a sealing station (d) where it is hermetically sealed at the top with a stopper (6).

FIG. 1 shows a general procedure for aseptic filling of a container comprising several steps.

The container (1), optionally inserted in a supporting cylinder (7) and capped with a nozzle cap (8), is subjected to an ionization stage (a) by means of an ionizer (2), of any type, e.g. ring, rod, gun, curtain, blades, barrel, needle or nozzle, or an ionizing filter, which may also include isolators with an ionizer on the top of the isolator, or any other type of ionizer. The ionizer (2) is used to remove the electrostatic charge from the container both on the inside walls and in the sealing area. This ionizer may or may not be applied together with a sterile stream of a carrier gas such as nitrogen, carrying ionized air molecules, or compressed air carrying ionized air molecules, although more preferably a nitrogen stream carrying ionized air molecules is used. The nitrogen stream carrying ionized air molecules that is used reaches both the inside of the container and the sealing area. By these two ionization processes (ionization with ionizer and the optional application of a sterile gas stream), the electrostatic charges in the container are removed so that the container can be filled.

After the ionization process (a), the syringe (1) passes to the aseptic filling station (b). In this stage the aseptic filling of the container (1) with the solid substance is carried out. This process requires the use of a hopper (3) containing the solid substance to be dispensed and a dispensing needle or nozzle (4) through which the solid substance is dispensed. A weighing cell (5) is also required to measure accurately the amount of solid substance that is dispensed. This station may or may not have a stream of a sterile carrier gas, such as compressed air or nitrogen, that carries ionized air molecules, preferably nitrogen carrying ionized air molecules to provide a vehicle for the ions. There are as many filling stations as products or combinations thereof to be filled.

After filling the container (1) with the solid, it is subjected to a deionization stage (c) by means of a deionizer (2), which may be a ring, rod, gun, curtain, blades, barrels, needle or nozzle, or an ionizing filter, including isolators with an ionizer on the top of the isolator. Together with the ionizer, a stream of a sterile carrier gas such as compressed air or nitrogen carrying ionized air molecules may or may not be applied; preferably, nitrogen carrying ionized air molecules is used to prevent the solid from adhering to the walls of the sealing area of the container (1).

Finally, there is the aseptic sealing station (d), where the stopper (6) is inserted to seal the container. The latter station may or may not use a stream of a sterile carrier gas such as compressed air or nitrogen, preferably carrying ionized air molecules.

Figure 2:
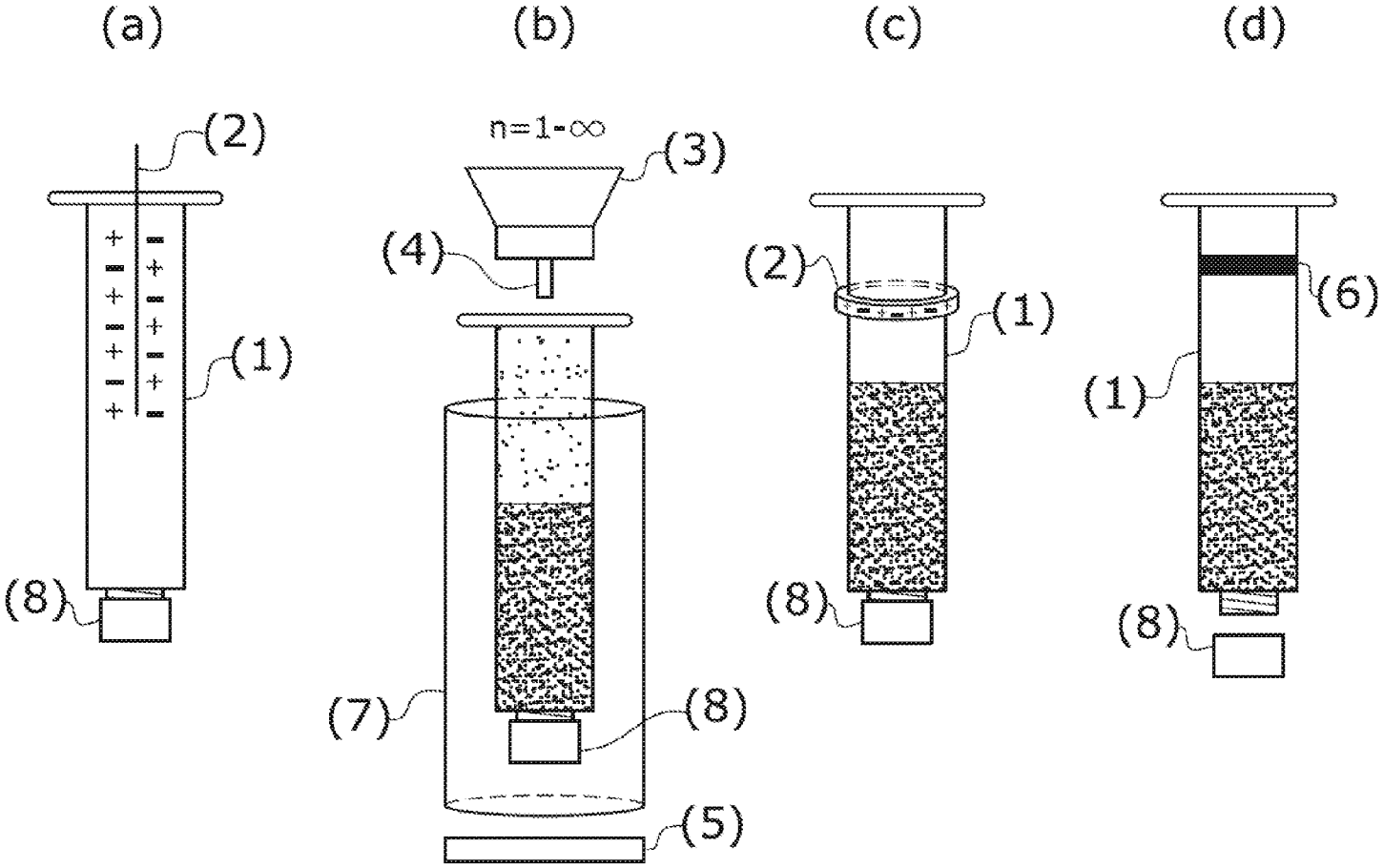
FIG. 2 depicts another particular embodiment of the process of the present invention, where the male syringe of FIG. 1 has been replaced by a female syringe as the pharmaceutical container (1).

FIG. 2 shows another embodiment of the ionization process consisting of four stages.

The first stage consists in an ionization process (a) similar to that shown in FIG. 1, in which a stream of a sterile carrier gas, such as nitrogen carrying ionized air molecules or compressed air carrying ionized air molecules, may or may not be introduced into the container (1), the syringe having been previously capped with the nozzle cap (8) and optionally introduced into the carrier cylinder (7). This sterile carrier gas stream is used in conjunction with an ionizer (2), whether in the form of a ring, rod, gun, curtain, blade, barrel, needle or nozzle, or an ionizing filter, which may also include isolators with an ionizer on the top of the isolator. The stream and ionizer (2) reach both the bottom of the container (1) and the sealing zone; in the present figure, the sterile carrier gas stream used is preferably a nitrogen stream carrying ionized air molecules. After applying this stream, the container is free of electrostatic charges and filling may start.

In the second stage of the described process, the container (1) passes to the aseptic filling station (b) where aseptic filling with the solid is carried out. In this station there are several elements such as: a hopper (3) in which the solid substance to be dispensed is located, a dispensing needle or nozzle (4) in charge of dispensing the solid, and a weighing cell (5) to control the exact amount of solid that is dispensed. There are as many filling stations as products or combinations thereof to be filled. In order to ensure the cleanliness of the sealing zone, a third stage is used which consists in an ionization stage (c) where an ionizer (2) is used, which may be a ring, rod, gun, curtain, blade, barrel, needle or nozzle, or an ionizing filter, among which there may also be isolators with an ionizer on the top of the isolator, where a stream of sterile carrier gas such as nitrogen carrying ionized air molecules or compressed air may or may not be applied as well in order to break the adhesion of the solid to the sides of the container in the sealing zone. Preferably, a nitrogen stream carrying ionized air molecules is used to serve as a vehicle for ion displacement and as a carrier means in the sweeping effect, thus obtaining the desired sealing phenomenon in this station. There will be different numbers of ionization stations according to the needs of each product.

Finally, the last stage consists of a sealing stage (d) in which the container is sealed with a stopper (6). A sterile carrier gas stream such as nitrogen, preferably carrying ionized air molecules, may or may not be used at this stage, because although the sealing area is clean of solids, it is necessary to ensure that the container is completely clean and that none of the dispensed solids adhere to the stopper used for sealing and to the container walls due to the electrostatic charges created by the friction when the container is placed in the sealer.

Figure 3:
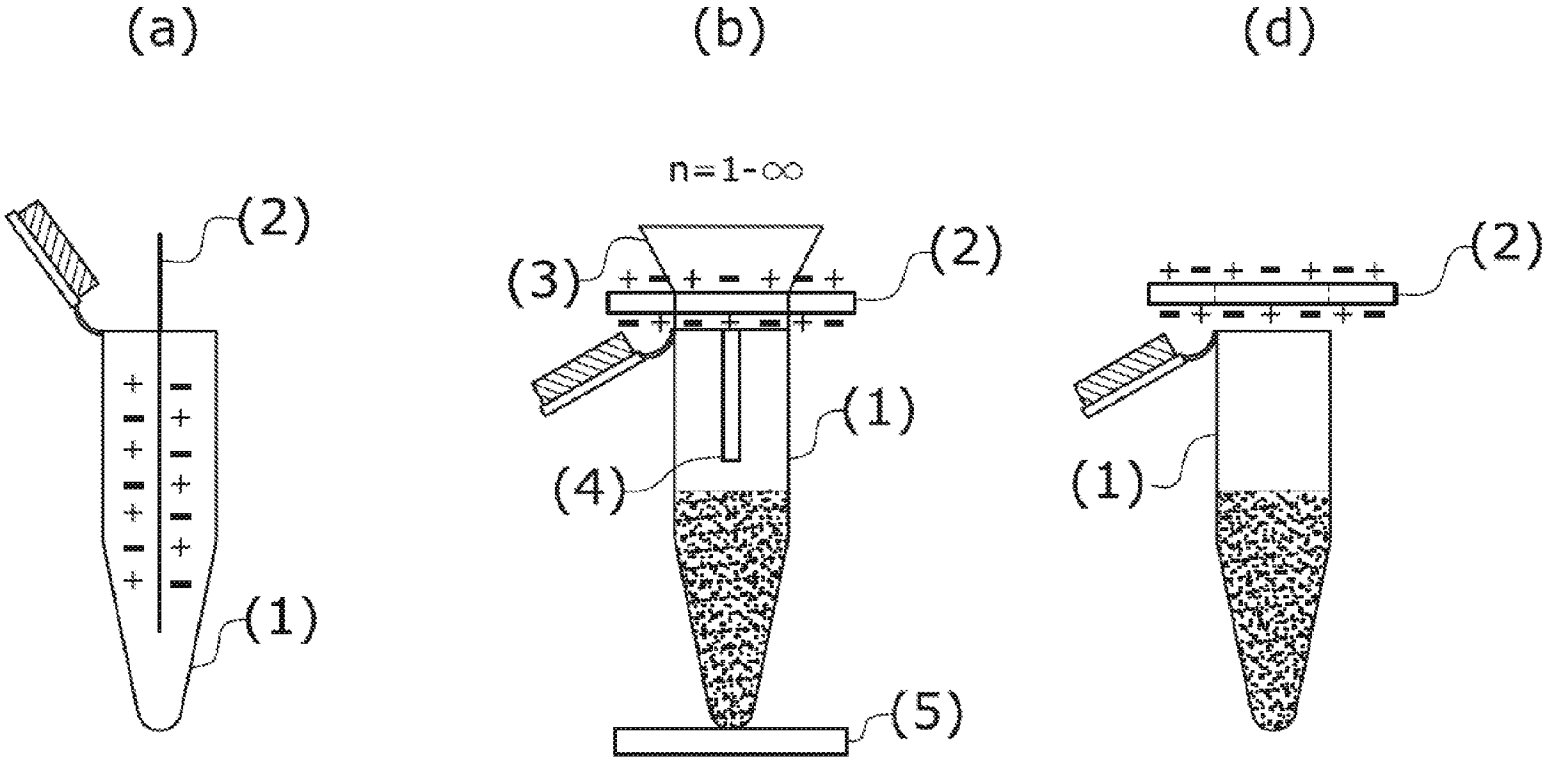
FIG. 3 depicts a particular embodiment of the process of the present invention, where the syringe has been replaced as the pharmaceutical container (1) by an Eppendorf® tube, which is subjected to an ionization stage (a) thanks to the presence in said stage of an ionizer (2) whether it be a ring, rod, gun, curtain, blades, barrels, needle or nozzle, or an ionizing filter, among which can also be found isolators with an ionizer on the top of said isolator, in this case a needle ionizer. It is then transferred to the filling station (b) (there may be multiple filling stations) where there is an ionizer (2) with a ring, bar, gun, curtain, blades, barrel, needle or nozzle, or an ionizing filter, among which there may also be isolators with an ionizer on the top of the isolator, in this case an ionizing filter. In addition to the ionizer, this stage contains a weighing cell (5), a hopper (3), and a nozzle or dispensing needle (4). Finally, after filling, the Eppendorf® tube is subjected to an ionization process by means of a ring, rod, gun, curtain, blades, barrel, needle or nozzle, or an ionizing filter, which may also include isolators with an ionizer on the top of the isolator, in this case a rod ionizer (2).

FIG. 3 shows another particular realization of the ionization process, comprising the following steps.

The container (1) is subjected to an ionization process (a), by means of an ionizer (2) which can be a ring, rod, gun, curtain, blade, barrel, needle or nozzle, or an ionizing filter, including isolators with an ionizer on the top of the isolator. This ionizer may or may not be applied together with a sterile carrier gas stream such as nitrogen carrying ionized air molecules or compressed air carrying ionized air molecules, although more preferably a nitrogen stream carrying ionized air molecules is used. The ionizer (2) is used to remove the electrostatic charge from the container both on the inside walls and in the sealing area. In addition, the nitrogen stream carrying ionized air molecules reaches both the inside of the container and the sealing area; with these two ionization processes, the electrostatic charges on the container are eliminated so that it can then be filled.

Subsequently, after this ionization phase (a), the container (1) passes to the aseptic filling station (b) where it is aseptically filled with the solid. In this station there are several elements such as a hopper (3) where the solid substance to be dispensed is located, a dispensing needle or nozzle (4) in charge of dispensing the solid, a weighing cell (5) to control the exact amount of solid that is dispensed and an ionizer (2) which can be a ring, bar, gun, curtain, blades, barrel, needle or nozzle, or an ionizing filter, among which there can also be isolators with an ionizer on the top of the isolator. This station may or may not have a stream of a sterile carrier gas, such as compressed air or nitrogen, that carries ionized air molecules, preferably nitrogen carrying ionized air molecules to provide a vehicle for the ions. This ensures that the dispensed solid does not remain in the sealing zone. There will be as many filling stations as there are products or combinations thereof to be filled, and as many ionization stages as necessary.

After the container (1) has been filled with the solid in the filling station (b), in order to ensure the cleanliness of the sealing area of the container the last stage is carried out, which is an ionization process (c) using an ionizer (2) either in the form of a ring, rod, gun, curtain, blades, barrel, needle or nozzle, or an ionizing filter, including isolators with an ionizer on the top of the isolator which may or may not act in conjunction with a stream of sterile carrier gas such as nitrogen carrying ionized air molecules or compressed air in order to break the adhesion of the solid to the sides of the container in the sealing zone. Preferably, a nitrogen stream carrying ionized air molecules is used to serve as a vehicle for ion displacement and as a carrier means in the sweeping effect, thus obtaining the desired sealing phenomenon in this station. There will be different numbers of ionization stations according to the needs of each product.

FIG. 4 shows another particular embodiment of the procedure described in the present invention.

The container (1), optionally inserted in a supporting cylinder (7) and capped with the nozzle cap (8), is subjected to an ionization process (a) by means of an ionizer (2), of any type in the form of a ring, rod, gun, curtain, blades, barrel, needle or nozzle, or an ionizing filter, which may also include isolators with an ionizer on the top of the isolator, or any other type of ionizer. This ionizer may or may not be applied together with a sterile carrier gas stream such as nitrogen carrying ionized air molecules or compressed air carrying ionized air molecules, although more preferably a nitrogen stream carrying ionized air molecules is used. The ionizer (2) is used to remove the electrostatic charge from the container both on the inside walls and in the sealing area. In addition, the nitrogen stream carrying ionized air molecules used reaches both the inside of the container and the sealing area; with these two ionization processes, the electrostatic charges on the container are eliminated so that it can then be filled.

After this ionization phase (a), the container (1) passes to the aseptic filling station (b) where it is aseptically filled with the solid. This process requires the use of a hopper (3) containing the solid substance to be dispensed and a dispensing needle or nozzle (4) through which the solid substance is dispensed. A weighing cell (5) is also required to measure accurately the amount of solid substance that is dispensed. This station may or may not have a stream of a sterile carrier gas, such as compressed air or nitrogen, that carries ionized air molecules, preferably nitrogen carrying ionized air molecules to provide a vehicle for the ions. There are as many filling stations as products or combinations thereof will be filled.

After the container (1) has been filled with the solid in the filling station (b), in order to ensure that the sealing area of the container is clean, a third stage is carried out, which is an ionization process (c) in which an ionizer (2) is used, either in the form of a ring, rod, gun, curtain, blades, barrel, needle or nozzle, or an ionizing filter, among which isolators with an ionizer on the top of the isolator can also be found. This ionizer may or may not act together with a stream of a sterile carrier gas such as nitrogen carrying ionized air molecules or compressed air, in order to break the adhesion of the solid to the sides of the container in the sealing area. Preferably, a nitrogen stream carrying ionized air molecules is used to serve as a vehicle for ion displacement and as a carrier means in the sweeping effect, thus obtaining the desired sealing phenomenon in this station. There will be different numbers of ionization stations according to the needs of each product.

Finally, the container (1) passes to the sealing station (d) where it is sealed with a stopper (6). In this stage an ionizer (2) is used which may be in the form of a ring, rod, gun, curtain, blade, barrel, needle or nozzle, or an ionizing filter, among which there may also be isolators with an ionizer on the top of the isolator which may or may not act together with a stream of sterile carrier gas such as nitrogen, preferably carrying ionized air molecules, because, although the sealing area is clean of solid substances, it is necessary to ensure that the container is completely clean and that none of the dispensed solid substances adheres to the stopper used for sealing and to the walls of the container due to the electrostatic charges created by friction when the container is placed in the sealing machine.

FIG. 5 shows another particular embodiment of the procedure described in the present invention.

The container (1) which has been capped with the nozzle cap (8) and optionally inserted into a support cylinder (7) is subjected to an ionization process (a) by means of an ionizer (2), whether in the form of a ring, rod, gun, curtain, blade, barrel, needle or nozzle, or an ionizing filter, including isolators with an ionizer on the top of the isolator, which may or may not be in conjunction with a sterile carrier gas stream such as nitrogen carrying ionized air molecules or compressed air carrying ionized air molecules, but more preferably nitrogen carrying ionized air molecules. The ionizer (2) is used to remove the electrostatic charge from the container both on the inside walls and in the sealing area. In addition, the nitrogen stream carrying ionized air molecules used reaches both the inside of the container and the sealing area; with these two ionization processes, the electrostatic charges on the container are eliminated so that it can then be filled.

After this ionization process (a), the container (1) passes to the aseptic filling station (b) where it is aseptically filled with the solid. In this station it is necessary to use several elements such as a hopper (3) where the solid substance to be dispensed is located, a dispensing needle or nozzle (4) in charge of dispensing the solid, and a weighing cell (5) to control the exact amount of solid that is dispensed. This station may or may not have a stream of a sterile carrier gas, such as compressed air or nitrogen, that carries ionized air molecules, preferably nitrogen carrying ionized air molecules to provide a vehicle for the ions. This ensures that the dispensed solid does not remain in the sealing zone. There are as many filling stations as products or combinations thereof will be filled.

After this filling stage (b), the container is subjected to an ionization stage (c) in which the ionizer (2) may be in the form of a ring, rod, gun, curtain, blades, barrel, needle or nozzle, or an ionizing filter, which may also include isolators with an ionizer on the top of the isolator, which may or may not be in conjunction with a sterile carrier gas stream such as nitrogen carrying ionized air molecules or compressed air carrying ionized air molecules, although more preferably the nitrogen stream carrying ionized air molecules is used.

Finally, the container (1) passes to the sealing station (d) where it is sealed with a stopper (6). In this stage an ionizer (2) is also used which may be in the form of a ring, rod, gun, curtain, blade, barrel, needle or nozzle, or an ionizing filter, among which there may also be isolators with an ionizer on the top of the isolator which may or may not act together with a stream of sterile carrier gas such as compressed air or preferably nitrogen carrying ionized air molecules, because, although the sealing area is clean of solid substances, it is necessary to ensure that the container is completely clean and that none of the dispensed solid substances adheres to the stopper used for sealing and to the walls of the container due to the electrostatic charges created by friction when the container is placed in the sealing machine.

FIG. 6 depicts a process with three stages.

In the first stage the container (1) is subjected to an ionization process (a) by means of an ionizer (2), whether in the form of a ring, rod, gun, curtain, blade, barrel, needle or nozzle, or an ionizing filter, including isolators with an ionizer on the top of the isolator, which may or may not be in conjunction with a sterile carrier gas stream such as nitrogen carrying ionized air molecules or compressed air carrying ionized air molecules, although more preferably nitrogen carrying ionized air molecules is used. The ionizer (2) is used to remove the electrostatic charge from the container both on the inside walls and in the sealing area. In addition, the nitrogen stream carrying ionized air molecules used reaches both the inside of the container and the sealing area; with these two ionization processes, the electrostatic charges on the container are eliminated so that it can then be filled.

After this ionization process (a), the container (1) passes to the aseptic filling station (b) where it is aseptically filled with the solid. This process requires the use of a hopper (3) containing the solid substance to be dispensed and a dispensing needle or nozzle (4) through which the solid substance is dispensed. A weighing cell (5) is also required to measure accurately the amount of solid substance that is dispensed. This station may or may not have a stream of a sterile carrier gas, such as compressed air or nitrogen, that carries ionized air molecules, preferably nitrogen carrying ionized air molecules to provide a vehicle for the ions. There are as many filling stations as products or combinations thereof will be filled.

Lastly, the container (1) passes to the ionization station. In this stage an ionizer (2) is used which may be in the form of a ring, rod, gun, curtain, blade, barrel, needle or nozzle, or an ionizing filter, among which there may also be isolators with an ionizer on the top of the isolator which may or may not act together with a stream of sterile carrier gas such as nitrogen, preferably carrying ionized air molecules, because, although the sealing area is clean of solid substances, it is necessary to ensure that the container is completely clean and that none of the dispensed solid substances adheres to the stopper and to the walls of the container due to the electrostatic charges created by friction when the container is placed in the sealing machine.

FIG. 7 depicts a particular embodiment of the procedure described in the present invention.

The container (1) already capped with a stopper (6) and optionally inserted in a cylinder (7) is ionized in an ionization stage (a) by means of an ionizer (2) in the form of a ring, rod, gun, curtain, blade, barrel, needle or nozzle, or an ionizing filter, among which can also be isolaters with an ionizer on the top of said isolator. This station may or may not have a stream of a sterile carrier gas, such as compressed air or nitrogen, that carries ionized air molecules, preferably nitrogen carrying ionized air molecules to provide a vehicle for the ions.

The container is then placed in the aseptic filling station (b), where it is aseptically filled with the desired solid with the nozzle part. In this station it is necessary to use several elements, such as a hopper (3) where the solid substance to be dispensed is located, a dispensing needle or nozzle (4) in charge of dispensing the solid, and a weighing cell (5) to control the exact amount of solid that is dispensed. There may or may not be a stream of a sterile carrier gas, such as compressed air or nitrogen, that carries ionized air molecules, preferably nitrogen carrying ionized air molecules to provide a vehicle for the ions. This ensures that the dispensed solid does not remain in the sealing zone. There are as many filling stations as products or combinations thereof will be filled.

After the container (1) has been filled with the solid in the filling station (b), in order to ensure that the sealing area of the container is clean, a final stage is carried out, which is an ionization process (c) in which an ionizer (2) is used, either in the form of a ring, rod, gun, curtain, blades, barrel, needle or nozzle, or an ionizing filter, among which isolators with an ionizer on the top of the isolator can also be found. This ionizer may or may not be next to a stream of a sterile carrier gas such as nitrogen carrying ionized air molecules or compressed air, in order to break the adhesion of the solid to the sides of the container in the sealing area. Preferably, a nitrogen stream carrying ionized air molecules is used to serve as a vehicle for ion displacement and as a carrier means in the sweeping effect, thus obtaining the desired sealing phenomenon in this station. There will be different numbers of ionization stations according to the needs of each product.

In the preferred embodiments shown in the figures, an additional ionization stage of the container can be executed after filling with the solid substance and immediately prior to sealing with the stopper. Preferably, the ionization must be performed also when the container is empty, before it is filled with the solid substance, and more preferably every station of the filling and sealing station must include ionizers to ionize both the container and the solid substance, thereby preventing adherence of the latter to the inner walls and ensuring the cleanliness of the container. These ionizers may be of any type, such as ring, rod, gun, curtain, blade, barrel, needle or nozzle, or an ionizing filter, among which can also be isolators with an ionizer on the top of said isolator. To aid the dosing (loading), a stream can be used of a sterile carrier gas such as compressed air or nitrogen, carrying ionized air molecules, as it provides a vehicle for displacement of the ions, generates an inert atmosphere, and provides a carrier means in the sweeping effect. This nitrogen current carrying ionized air molecules is used in the ionization stations together with an ionizer. More preferably, it is used in all the stations of the aseptic filling and sealing process.

Such solids, i.e. pharmaceutical solids, include by way of example and without limitation compounds such as risperidone, paliperidone, fentanyl, olanzapine, letrozole, aripiprazole, anastrozole, asenapine, brexiprazole, cariprazine, clozapine, iloperidone, lurasidone, quetiapine, ziprasidone, among others, including any derivatives, metabolites or salts (such as pamoate or palmitate) thereof alone or in combination.

Other examples of such compounds are also biocompatible polymers of the polylactic acid (PLA), polyglycolic acid (PGA) types and their copolymers polylactic co-glycolic acid (PLGA) including any derivatives or copolymers, alone or in combination.

EXAMPLES

The following specific examples are provided to illustrate the nature of the present invention. These examples are included for purposes of illustration only and should not be understood as limiting the invention claimed herein.

These examples use as containers cartridges or carpules, syringes with a needle or with a catheter cone, Luer cone, or Luer lock cone; all of them with a male tip or female tip and Eppendorf® tubes, as excipients biocompatible polymers of the PLGA (lactic or glycolic acid) and PLA (poly(lactic acid)) type, and as active ingredients Risperidone and Letrozole respectively The following specific examples provided below serve to illustrate the nature of the present invention. These examples are included only for illustration purposes and are not to be deemed to limit the invention to just said exemplary embodiments. The invention is defined by the claims, drawings, abstract and entire specification.

Example 1: Filling of a 50 mg Dose of Risperidone in a Syringe With a Male Nozzle or Male Syringe In this example, two products must be filled in a pharmaceutical container, specifically in a glass syringe with a male nozzle that has been precapped with the nozzle cap (8). The products to be filled are the excipient PLA and the active ingredient risperidone, specifically a 50 mg dose. It should be noted that the filling process takes place inside a rigid-walled aseptic isolator. Before starting the filling process, all the equipment must be clean and sterile. For this purpose, the equipment is previously sterilized with nebulized or vaporized hydrogen peroxide, or with a mixture of hydrogen peroxide and peracetic acid.

The isolator comprises two main sections: (i) the transfer chamber (TC), which is a chamber that facilitates loading sterile materials to and from the working chamber of the isolator, as all the materials and tools loaded in the sterile isolator must be previously sterilized; and (ii) the working chamber (MC), which contains filling equipment for the excipient and the active ingredient, and a syringe capping or sealing unit.

To start the filling the male syringes (1) and the caps (6) are taken, both sterile, delivering said caps to the operator in the capping or sealing station (d) so that they are inserted in the syringe sealing machine. There are as many filling stations as products or combinations thereof that will be filled.

Both the PLA used as excipient and the Letrozole used as active ingredient are delivered to the operators at the filling station (b), who load them in their respective hoppers (3). The male syringes (1) that will be used for filling undergo an ionization process from the rear part of the syringes or from the collar of the syringes using a needle ionizer (2). In this way the male syringes (1) are ionized (a) to eliminate the electrostatic charge inside them and in the sealing area of the syringe body. The male syringe (1) is then placed upside down inside a cylinder (7).

The cylinder (7) containing the ionized male syringe (1) is directed towards the filling station (b) to fill with PLA. The male syringe (1) is placed in the weighing cell (5), taring its weight to zero. After this, the male syringe (1) is filled at the end proximal to the collar with 90 mg±30% of PLA. Filling is carried out with a dispensing needle or nozzle (4), both made from a non-conducting material. The male syringe (1) is continuously weighed during filling so that the system can be controlled to stop filling when the desired weight is precisely reached, in this case between 90 mg±30%.

After this process, the electrostatic charge inside the inner walls of the container (1) is measured and the measurement obtained is 1075 volts.

After the filling station (b) with the PLA excipient, the male syringe (1) is subjected to an ionization process (c) using a ring ionizer located on the outside of the syringe to facilitate sealing by preventing the PLA from adhering to the walls of the male syringe (1). During this process, the presence of a stream of nitrogen or sterile carrier gas with ionized air molecules is necessary to displace the ions and act as a carrier for the powder sweeping effect.

After this process, the electrostatic charge inside the inner walls of the container (1) is measured and the measurement obtained is 775 volts.

Once the excipient has been filled and ionized, the cylinder (7) with the male syringe (1) filled with PLA is placed in the filling station (b) in order to fill it with 50 mg±30% of Letrozole. The cylinder with the male syringe (1) is placed in the weighing cell (5) where it is tared before filling with the active product. The male syringe (1) is continuously weighed during filling so that filling can be stopped once the desired weight has been reached.

After this filling process of the male syringe (1), it is subjected to another ionization process (c) with the help of a ring ionizer (2) to prevent both the excipient and the active ingredient with which the male syringe (1) has been filled from adhering to the walls of the male syringe (1). This process requires the presence of a stream of nitrogen or sterile carrier gas with ionized air molecules to displace the ions and act as a carrier for the powder sweeping effect.

After this process, the electrostatic charge inside the inner walls of the container (1) is measured and the measurement obtained is 645 volts.

After filling with the active ingredient and subsequent ionization, the cylinder (7) with the male syringe (1) passes to the sealing station (d) where the stopper (6) is fitted. This process requires the presence of a stream of nitrogen or sterile carrier gas carrying ionized air molecules to displace the ions and act as a carrier.

After this process, the electrostatic charge inside the inner walls of the container (1) is measured and the measurement obtained is 375 volts.

In this way the desired sealing phenomenon is achieved and the cleanliness of the sealing area inside the syringe body at the distal end of the nozzle thereof is ensured. It also prevents both PLA and Letrozole from sticking to the stopper (6) used for sealing and to the walls of the container due to the electrostatic charges created by the friction created when the container is placed in the sealer.

Once the male syringe has been filled and sealed, it can be placed on a tray with the rest of the filled and sealed syringes.

Example 2: Filling of a 400 mg Dose of Letrozole in a Syringe With a Female Nozzle or Female Syringe of Plastic Material In this second example, PLA is also used as excipient and Letrozole as active ingredient for a dose of 400 mg, and the filling process also takes place inside a rigid-walled aseptic isolator in the same way as in example 1.

Both the PLA used as excipient and the Letrozole used as active ingredient are delivered to the operators at the filling station (b), who load them into their respective hoppers (3), in this case without the hoppers being made of insulating material. The female syringes (1), pre-capped with the nozzle cap (8), that will be used for filling are arranged under a stream of nitrogen or sterile carrier gas carrying ionized air molecules; a needle ionizer (2) is added to this process, such that the female syringes are ionized (a) to eliminate the electrostatic charge inside them and in the sealing zone.

The cylinder (7) containing the ionized female syringe (1) is directed towards the filling station (b) with PLA. The female syringe (1) is placed in the weighing cell (5), taring its weight to zero. After this, the syringe (1) is filled from the back of the syringes or from the collar part of the syringes with an amount of 500 mg+30% PLA, this filling is done by means of a nozzle (4) or dispensing needle, which is not made of insulating material. The syringe (1) is continuously weighed during filling, so that the system can be controlled to stop filling when the desired weight, in this case between 500 mg+30%, is reached. During this process the presence of a stream of nitrogen or sterile carrier gas with ionized air molecules is required to displace the ions and provide a carrier in the sweeping effect.

After this process, the electrostatic charge inside the inner walls of the container (1) is measured and the measurement obtained is 1770 volts.

Subsequently, the cylinder (7) with the female syringe (1) filled with PLA undergoes an ionization process (c) before being filled in a second filling station (b) with the active ingredient Letrozole. For the ionization, a ring ionizer (2) is used to ionize the PLA adhering to the walls of the sealing area of the syringe (1). A stream of nitrogen or sterile carrier gas carrying ionized air molecules is also used to serve as a vehicle for the displacement of the ions and as a carrier in the sweeping effect, thus achieving the desired sealing phenomenon in this ionization process.

After this process, the electrostatic charge inside the inner walls of the container (1) is measured and the measurement obtained is 975 volts.

After ionization, the cylinder (7) with the female syringe (1) filled with PLA is placed in the filling station (b) with 400 mg±30% of the active ingredient Letrozole. The cylinder (7) with the female syringe (1) is placed in the weighing cell (5) where it is tared before filling with the active ingredient, and then filling with Letrozole begins. The syringe (1) is continuously weighed during filling so that filling can be stopped once the desired weight has been reached.

It is then transferred to an ionization station (c) in which a ring ionizer (2) is used to prevent adherence of both the excipient and the active substance to its walls.

After this process, the electrostatic charge inside the inner walls of the container (1) is measured and the measurement obtained is 895 volts, as both the dispensing needle and the hopper are not insulating materials.

After filling with the active ingredient and subsequent ionization, the cylinder (7) with the female syringe (1) (d) is filled with the active ingredient and a stopper (6) is fitted in it. This process requires the presence of a stream of nitrogen or sterile carrier gas carrying ionized air molecules to displace the ions and act as a carrier for the powder. By this means, the desired sealing phenomenon is achieved and the cleaning of the sealing area inside the syringe body is ensured to leave a clean area in which the stopper is inserted. Furthermore, it prevents both PLA and Letrozole from adhering to the stopper (6) used for sealing and to the walls of the container due to the electrostatic charges created by friction when the container is placed in the sealer.

At this point, the electrostatic charge inside the inner walls of the container (1) is measured and the measurement obtained is 495 volts.

Once the syringe filling process is completed and it has been sealed, the syringe can be placed on a tray with the rest of the filled and sealed syringes.

Example 3: Filling of a 50 mg Dose of Letrozole in Eppendorf® Tubes

In this example PLA is used as excipient and Letrozole as active ingredient, for a dose of 50 mg. It should be noted that the filling process takes place inside a rigid-walled aseptic isolator, as in the previous examples.

Both the PLA used as excipient and the Letrozole used as active ingredient are delivered to the operators at the filling station (b), who load them in their respective hoppers (3). The Eppendorf® tubes (1) to be used for filling are arranged under a stream of nitrogen or sterile carrier gas carrying ionized air molecules; a needle ionizer (2) is added to this process and the Eppendorf® tubes (1) are ionized to remove the electrostatic charge inside them and in the sealing zone.

At this point the electrostatic charge inside the inner walls of the container (1) is measured and the measurement obtained is 695 volts, as the tube is made of insulating material and the dimensions of the tube are significantly different from the syringes, as they are wider and shorter than the syringes of examples 1 and 2.

The ionized Eppendorf® tube (1) is led to the filling station with 50 mg±30% Letrozole. The Eppendorf® tube (1) is placed in the weighing cell (5), taring its weight to zero. The Eppendorf® tube (1) is then filled with the active ingredient by means of a nozzle (4) made of insulating material. The Eppendorf® tube (1) is continuously weighed during filling, so that the system can be controlled to stop filling when the desired weight is reached. While filling with Letrozole, it is necessary to use an ionization filter (2) to prevent it from sticking to the walls of the sealing area.

After the filling stage (b), the Eppendorf® tube (1) is again subjected to an ionization process (c) with the aid of a rod ionizer (2), to ensure that no active ingredient remains adhering to the walls of the container (1).

Again, the electrostatic charge inside the inner walls of the container (1) is measured and the measurement obtained is 700 volts.

After filling with the active ingredient, the Eppendorf® tube (1) filled with Letrozole is placed in the second filling station (b), this time with 90±30% of the excipient PLA. The Eppendorf® tube (1) is placed in the weighing cell (5) where it is tared before filling with the excipient, after which filling with PLA begins. The Eppendorf® tube (1) is continuously weighed during filling, so that filling can be stopped once the desired weight has been reached. During this process, the use of an ionization filter (2) is necessary to prevent both Letrozole and PLA from adhering to the sealing area.

After this filling process of the Eppendorf® tube (1), the tube is subjected to another ionization process (c) with the aid of a rod ionizer (2) to prevent both the excipient and the active ingredient with which the Eppendorf® tube (1) has been filled from adhering to the walls of the container (1). The presence of a stream of nitrogen or sterile carrier gas carrying ionized air molecules is also necessary to displace ions and act as a carrier. These two means ensure that the electrostatic charge on the inside of the inner walls of the container (1) is about 595 volts, thus achieving the desired sealing phenomenon and ensuring the cleanliness of the sealing area, as well as preventing both PLA and Letrozole from adhering to the stopper (6) used for sealing and to the walls of the container due to the electrostatic charges created by friction when the container is placed in the sealing machine.

Example 4. Filling of a 75 mg Dose of Risperidone in a Syringe With Needle or Syringe With Needle Made of Plastic Material In this example, PLGA is used as excipient and Risperidone as active ingredient, for a dose of 75 mg. The filling process also takes place inside a rigid-walled aseptic isolator using the same material sterilization operation as in the previous examples.

The syringes with needle (1) to be used for filling are closed with the nozzle cap (8) and are subjected to an ionization process with a needle ionizer (2), thereby ionizing (a) the syringes (1) in order to eliminate the electrostatic charge inside them and in the sealing area. The cylinder (7) containing the syringe with the ionized needle (1) is made in this case of an insulating material. The syringe (1) is placed in the weighing cell (5), taring its weight to zero. After this, the male syringe (1) is filled with 75 mg±30% of PLGA by means of a nozzle (4) made of insulating material. The syringe (1) is continuously weighed during filling so that the system can be controlled to stop filling when the desired weight, in this case between 75 mg±30%, is reached.

After this process, the electrostatic charge inside the inner walls of the container (1) is measured and the measurement obtained is 775 volts.

After filling the needle syringe (1) with the excipient, it is subjected to an ionization process (c) by means of a ring ionizer (2), thus preventing the PLGA from adhering to the walls of the sealing area of the container (1).

After this process, the electrostatic charge inside the inner walls of the container (1) is measured and the measurement obtained is 550 volts.

After filling with the excipient and subsequent ionization, the cylinder (7) with the syringe (1) filled with PLGA is placed in the next filling station (b) with the active ingredient Risperidone. The cylinder (7) with the syringe (1) is placed in the weighing cell (5), where it is tared before filling with the active ingredient, and then filling with Risperidone begins. The syringe (1) is continuously weighed during filling so that filling can be stopped once the desired weight has been reached.

After filling with the active ingredient, the cylinder (7) with the needle syringe (1) is again subjected to an ionization process, where with the aid of a ring ionizer (2), both the active ingredient and the excipient are prevented from adhering to the walls of the sealing area of the male syringe (1). After this process, the electrostatic charge inside the inner walls of the container (1) is measured and the measurement obtained is 470 volts.

After this ionization process, the male syringe (1) passes to the sealing station (d) where it is fitted with a stopper (6) and undergoes a further ionization process. This process requires a rod ionizer (2) to ionise the PLGA and Risperidone that are adhered to the walls of the sealing area.

After this process, the electrostatic charge inside the inner walls of the container (1) is measured and the measurement obtained is 199 volts.

The ionization process ensures an optimum sealing and the total cleanliness of the sealing area, as well as preventing both PLGA and Risperidone from adhering to the stopper (6) used for sealing and to the walls of the container due to the electrostatic charges created by the friction created when the container is placed in the sealer.

Example 5: Filling of a 100 mq Dose of Risperidone in a Syringe With a Female Nozzle or a Female Syringe Made of Plastic Material In this example, PLGA is used as excipient and Risperidone as active ingredient, for a dose of 100 mg. The filling process also takes place inside a rigid-walled aseptic isolator using the same material sterilization operation as in the previous examples.

The female syringes (1) pre-capped with the nozzle cap (8) to be used for filling are subjected to an ionization process by a ring ionizer (2), thus ionizing (a) the syringes (1) to remove the electrostatic charge inside them and in the sealing area. The cylinder (7) containing the ionized syringe (1) in this case is made of an insulating material. The syringe (1) is placed in the weighing cell (5), taring its weight to zero. Then the syringe (1) is filled with 100 mg±30% of PLGA by means of a nozzle (4) made of insulating material. The syringe (1) is continuously weighed during filling so that the system can be controlled to stop filling when the desired weight, in this case between 100 mg±30%, is reached.

After this process, the electrostatic charge inside the inner walls of the container (1) is measured and the measurement obtained is 785 volts.

After filling the female syringe (1) with the excipient, it is subjected to an ionization process (c) using a needle ionizer (2), thus preventing the PLGA from adhering to the walls of the sealing area of the container (1).

After this process, the electrostatic charge inside the inner walls of the container (1) is measured and the measurement obtained is 580 volts.

After filling with the excipient and subsequent ionization, the cylinder (7) with the syringe (1) filled with PLGA is placed in the next filling station (b) with the active ingredient Risperidone. The cylinder (7) with the syringe (1) is placed in the weighing cell (5), where it is tared before filling with the active ingredient, and then filling with Risperidone begins. The syringe (1) is continuously weighed during filling so that filling can be stopped once the desired weight has been reached.

After filling with the active ingredient, the cylinder (7) with the syringe (1) is again subjected to an ionization process, where with the help of a needle ionizer (2), both the active ingredient and the excipient are prevented from adhering to the walls of the sealing area of the syringe (1). After this process, the electrostatic charge inside the inner walls of the container (1) is measured and the measurement obtained is 440 volts.

After this ionization process, the syringe (1) passes to the sealing station (d) to be fitted with the stopper (6) and undergoes a further ionization process. This process requires a rod ionizer (2) to ionize the PLGA and Risperidone that are adhered to the walls of the sealing area. After this process, the electrostatic charge inside the inner walls of the container (1) is measured and the measurement obtained is 197 volts.

The ionization process ensures an optimum sealing and the total cleanliness of the sealing area, as well as preventing both PLGA and Risperidone from adhering to the stopper (6) used for sealing and to the walls of the container due to the electrostatic charges created by the friction created when the container is placed in the sealer.

Example 6: Filling of a 75 mq Dose of Risperidone in Cartridges or Carpules

In this other example, PLGA is used as excipient and Risperidone as active ingredient, for a dose of 75 mg. The filling process also takes place inside a rigid-walled aseptic isolator using the same material sterilization operation as in the previous examples.

Both the PLGA used as excipient and the Risperidone used as active ingredient, as well as the cartridges, are delivered to the operators at the filling station (b) and loaded into their respective hoppers (3). The cartridges or carpules (1) to be used for filling are arranged under a stream of nitrogen or sterile carrier gas carrying ionized air molecules, a needle ionizer (2) is added to this process, and the cartridges or carpules (1) are ionized to eliminate the electrostatic charge inside them.

After this process, the electrostatic charge inside the inner walls of the container (1) is measured and the measurement obtained is 1285 volts.

The ionized cartridge or carpule (1) is directed to the filling station (b) with 75 mg±30% Risperidone. The cartridge (1) is placed in the weighing cell (5) face up, taring its weight to zero. Then the cartridge (1) is filled with Risperidone through the nozzle of the cartridge using a nozzle (4) or dispensing needle made of insulating material. The cartridge (1) is continuously weighed during filling so that the system can be controlled to stop filling when the desired weight is reached.

Once the cartridge (1) has been filled with the active ingredient, it is placed in the second filling station (b), this time with 100 mg±30% of the excipient PLGA. The cartridge (1) is placed in the weighing cell (5) where it is tared before being filled with this active ingredient, after which the filling with PLGA also starts from the nozzle. The cartridge (1) is continuously weighed during filling, so that filling can be stopped once the desired weight has been reached.

After filling with the PLGA excipient, the cartridge (1) undergoes a further ionization process using a rod ionizer (2) and a stream of nitrogen or sterile carrier gas carrying ionized air molecules to displace the ions and act as a carrier for the insertion of the cartridge nozzle cover. These two processes prevent both the excipient and the active ingredient from adhering to the walls, thus achieving the sealing phenomenon.

After this process, the electrostatic charge inside the inner walls of the container (1) is measured and the measurement obtained is 1085 volts.

Example 7. Filling of a 400 mq Dose of Risperidone in a Pre-Capped Female Syringe In this example, PLGA is used as excipient and Risperidone as active ingredient, for a dose of 400 mg. The filling process also takes place inside a rigid-walled aseptic isolator using the same material sterilization operation as in the previous examples.

The female syringes (1) to be used for filling are subjected to an ionization process by means of a ring ionizer (2), so that the syringes (1) are ionized (a) to eliminate the electrostatic charge inside them and in the sealing area. The cylinder (7) containing the ionized syringe (1) in this case is made of an insulating material. The syringe (1) is placed in the weighing cell (5) upside down since it is previously closed with a stopper (6), taring its weight to zero. After this, the syringe (1) is filled through the nozzle with 100 mg+30% PLGA, using a nozzle (4) made of insulating material. The syringe (1) is continuously weighed during filling so that the system can be controlled to stop filling when the desired weight, in this case between 100 mg±30%, is reached.

After this process, the electrostatic charge inside the inner walls of the container (1) is measured and the measurement obtained is 735 volts.

After filling the female syringe (1) with the excipient, it is subjected to an ionization process (c) using a rod ionizer (2), thus preventing the PLGA from adhering to the walls of the container (1) near the nozzle.

After this process, the electrostatic charge inside the inner walls of the container (1) is measured and the measurement obtained is 530 volts.

After filling with the excipient and subsequent ionization, the cylinder (7) with the syringe (1) filled with PLGA is placed in the next filling station (b) with the active ingredient Risperidone. The cylinder (7) with the syringe (1) is placed in the weighing cell (5), where it is tared before filling with the active ingredient, and then filling with Risperidone begins. The syringe (1) is continuously weighed during filling so that filling can be stopped once the desired weight has been reached.

After filling with the active ingredient, the cylinder with the syringe (1) is again subjected to an ionization process, where, with the help of a rod ionizer (2), both the active ingredient and the excipient are prevented from adhering to the walls of the syringe (1). After this process, the electrostatic charge inside the inner walls of the container (1) is measured and the measurement obtained is 215 volts.

The ionization process provides an optimum sealing and the precise dosage required.

In view of the above description and the examples below, one of ordinary skill in the art will be able to practice the invention as claimed without undue experimentation. The foregoing will be better understood with reference to the following examples that detail certain procedures for the preparation and/or practice of embodiments of the present invention. All references made to these examples are for the purposes of illustration. The examples should not be considered exhaustive, but merely illustrative of only a few of the many embodiments contemplated by the present invention.

As used herein, the term "about" or "approximately" are taken to mean ±20%, ±15%, ±10%, ±5%, ±2.5%, or ±1% of a specified valued. As used herein, the term "substantially" is taken to mean "to a large degree" or "at least a majority of" or "more than 50% of". Moreover, all ranges specified herein are inclusive of the range limits and all integer and fractional values therein especially as defined by the definition of the term "about".

The invention claimed is:

1. A method of filling pharmaceutical container(s) with at least one pharmaceutical solid, the method comprising the steps of providing an electrically conductive receptacle for at least one pharmaceutical container;

providing at least one pharmaceutical container, with respective interior surface(s), and placing said at least one pharmaceutical container in said receptacle;

directly or indirectly ionizing at least said receptacle and at least said pharmaceutical container to reduce or dissipate respective electrostatic charge(s); then loading at least one pharmaceutical solid into said at least one pharmaceutical container; and optionally, directly or indirectly ionizing said at least one pharmaceutical solid before, during, and/or after said loading.

2. The method of claim 1 comprising the steps of providing an electrically conductive receptacle for at least one pharmaceutical container;

providing at least one pharmaceutical container, with respective interior surface(s), and placing said at least one pharmaceutical container in said receptacle;

directly or indirectly ionizing at least said receptacle and at least said pharmaceutical container to reduce or dissipate respective electrostatic charge(s); then loading at least one pharmaceutical solid into said at least one pharmaceutical container and weighing said container during said loading; and directly or indirectly ionizing said at least one pharmaceutical solid before, during, and/or after said loading.

3. The method of claim 2 comprising the steps of providing an electrically conductive receptacle for at least one pharmaceutical container;

providing at least one pharmaceutical container, with respective interior surface(s), and placing said at least one pharmaceutical container in said receptacle;

directly or indirectly ionizing at least said receptacle and at least said pharmaceutical container to reduce or dissipate respective electrostatic charge(s); then loading a first pharmaceutical solid into said at least one pharmaceutical container and weighing said container during said loading;

directly or indirectly ionizing said first pharmaceutical solid before, during, and/or after said loading;

loading a second pharmaceutical solid into said at least one pharmaceutical container and weighing said container during said loading;

directly or indirectly ionizing said first and second pharmaceutical solids in said container before, during, and/or after said loading.

4. A method of filling pharmaceutical container(s) with at least one pharmaceutical solid, the method comprising the steps of providing at least one pharmaceutical container with respective interior surface(s);

providing at least one pharmaceutical solid;

loading said at least one pharmaceutical solid into said at least one pharmaceutical container; and at least before said loading, ionizing said at least one pharmaceutical container to reduce or dissipate electrostatic charge on said at least one pharmaceutical container, wherein the method further comprises one or more of the following steps: a) gravimetrically checking the weight of solid dispensed into the container; b) sealing the pharmaceutical container; c) ionizing any parts in contact with said receptacle, said container walls, or with the solid dispensed inside the container; d) said loading is conducted with a vibrating dispenser; e) repeating said loading and ionizing steps to load more than one pharmaceutical solid into said container; f) conducting an ionized sterile gas stream to the inside of the pharmaceutical container during loading, ionizing, and/or sealing; g) placing said container into a grounded and electrically non-conductive holder, preferably before said loading; h) ionizing the container(s) before and after placement into respective receptacle(s) (cylinder(s)); i) ionizing with ionized sterile gas stream; j) ionizing with ionizer(s); k) ionizing with ionized sterile gas stream and with ionizer(s); l) sterilizing at least said pharmaceutical container prior to said loading; m) providing an electrically conductive receptacle (cylinder) within which said pharmaceutical container is placed prior to said loading; n) directly or indirectly ionizing said electrically conductive receptacle; o) directly or indirectly ionizing said electrically conductive receptacle and said pharmaceutical container; p) weighing said container during said loading; q) sealing said container after completion of said loading; and/or r) directly or indirectly ionizing said container before and/or during said sealing.

5. The method of claim 4, wherein the sealing process of the present invention is carried out in a single stage with a complete sealing, without the need to resort to subsequent sealing stages.

6. The method of claim 4, wherein the method comprises ionizing both the solid and the pharmaceutical container where it is to be deposited, as well as ionizing the elements of the dosing and capping equipment that comes into contact with the container and/or the powder, at one or more stages of the filling procedure, in order to prevent the solid from tending to adhere to the walls of the container, as well as the walls of the container from tending to attract the solid particles, so that the only tendency of the solid is to fall to the bottom of the container and not be deposited on its walls.

7. The method of claim 4, wherein the loading of the pharmaceutical container with the solid is preferably carried out using a dispensing needle whose tip or dispensing end is located, throughout the loading stage, at a height between 1 to 3 mm above the surface of the solid deposited on the bottom of the container, so as to avoid turbulence that could lift the deposited solid towards the walls.

8. A method of filling pharmaceutical container(s) with at least one pharmaceutical solid, the method comprising the steps of providing at least one pharmaceutical container with respective interior surface(s);

providing at least one pharmaceutical solid;

loading said at least one pharmaceutical solid into said at least one pharmaceutical container; and at least before said loading, ionizing said at least one pharmaceutical container to reduce or dissipate electrostatic charge on said at least one pharmaceutical container, wherein a) the static charge(s), if present after said ionizing, on said interior surfaces is less than 2000 volts, less than 1000 volts, less than 500 volts, or less than 200 volts; b) said ionizing is conducted within the interior of said container; c) said ionizing is carried out when the pharmaceutical container is empty; d) one or more ionizers are located on the outside and/or inside of the pharmaceutical container; e) said ionizing is conducted before and/or during sealing of said container; f) the tip of a dispenser for said loading is at a height (h) of about 1 to about 3 mm or about 2 mm above the surface of respective solid deposited in the container; g) a dispenser for said loading is vertically displaceable during said loading, whereby said dispenser moves upwards as the filling stage progresses in order to maintain the distance (h) between the dispensing end of the dispensing needle and the surface of the loaded solid; h) said container and a dispenser for said loading are both vertically displaceable during said loading in order to maintain the distance (h) between the dispensing end of the dispensing needle and the surface of the loaded solid; i) the container is filled from the distal part with respect to a collar of the container when the container is a syringe or cartridge; j) the container is filled from the distal part with respect to a nozzle of the container when the container is a syringe or cartridge; k) the container is sealed under vacuum; l) said ionizing is conducted with at least one ionizer selected from the group consisting of ring, rod, bar, gun, curtain, blade, gun, needle or filter ionizer(s), and isolator(s) with an ionizer on the top thereof; m) a dispenser load solid(s) from at least one hopper into said container; n) a dispenser and/or hopper are made of a non-conductive material; o) the container comprises an electrically non-conductive material; p) a tip of the dispenser comprises a containment element to prevent said solid from being dispersed above the level of the dispensing tip or end of the dispensing tip during filling; q) one or more steps of said process is conducted in an aseptic environment in an area with unidirectional air flow; r) said ionizing is conducted before and during said loading; or any combination of two or more of the above.

9. The method of claim 8 comprising controlling the potential applied to the ionizers to reduce electrostatic charge on the container walls and/or the dispensed solid to preferably less than 2,000 V, more preferably less than 500 V, and most preferably less than 200 V.

10. A system for loading pharmaceutical solid(s) into pharmaceutical container(s), the system comprising plural receptacles adapted to receive and temporarily retain respective pharmaceutical container(s);

at least one first ionizer adapted to directly or indirectly reduce or dissipate electrostatic charge on interior surface(s) of said pharmaceutical container;

at least one dispenser of pharmaceutical solid(s);

at least one weighing cell adapted to gravimetrically weigh said container(s) and said pharmaceutical solid(s) during loading of said solid(s) into said container(s);

at least one other ionizer adapted to directly or indirectly reduce or dissipate electrostatic charge of said pharmaceutical solid(s), wherein a) said receptacles comprise an electrically conductive material; b) said receptacles comprise an electrically nonconductive material; c) said dispenser comprises a height adjustable dispensing end; d) said sealer is adapted to seal said container(s); e) said first ionizer is adapted to directly or indirectly reduce or dissipate electrostatic charge on said receptacle(s); f) said dispenser comprises is adapted to maintain the tip of a respective dispensing end at a height (h) of about 1 to about 3 mm or about 2 mm above the surface of respective solid deposited in the container during loading of said solid into said container; g) said dispenser is vertically displaceable during said loading, whereby said dispenser moves upwards as the filling stage progresses in order to maintain the distance (h) between the dispensing end of the dispensing needle and the surface of the loaded solid; h) a tip of said dispenser comprises a containment element to prevent said solid from being dispersed above the level of the dispensing tip or end of the dispensing tip during filling; or i) any combination of two or more of the above.

11. The system of claim 10 further comprising a) a sealer for said container(s); b) a reservoir for said container(s); c) a reservoir for said pharmaceutical solid(s); d) an ionizer adapted to form an ionized sterile gas stream; e) a sterilizer for said system and/or said container(s); or f) any combination of two or more of the above.

12. The system of claim 10 further comprising a cylinder (receptacle) acting as a support for the container.

13. The system of claim 12, wherein said cylinder a) facilitates handling of the container without contact with same; b) protects the process or containers from air streams by being part of the "exclusion hood"; and/or c) serves as an element for vertical support of the container on the weighing cell for accurate weighing.

* * * * *